US010800172B2

(12) United States Patent
Chikamoto et al.

(10) Patent No.: US 10,800,172 B2
(45) Date of Patent: Oct. 13, 2020

(54) LIQUID EJECTING APPARATUS

(71) Applicant: SEIKO EPSON CORPORATION, Tokyo (JP)

(72) Inventors: Motonori Chikamoto, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/113,105

(22) Filed: Aug. 27, 2018

(65) Prior Publication Data

US 2019/0061346 A1 Feb. 28, 2019

(30) Foreign Application Priority Data

Aug. 28, 2017 (JP) ..... 2017-163416

(51) Int. Cl.
*B41J 2/045* (2006.01)
*B41J 3/407* (2006.01)
*B41J 2/14* (2006.01)

(52) U.S. Cl.
CPC ..... *B41J 2/04588* (2013.01); *B41J 2/04515* (2013.01); *B41J 2/04541* (2013.01); *B41J 2/04581* (2013.01); *B41J 2/04593* (2013.01); *B41J 2/04596* (2013.01); *B41J 2/14233* (2013.01); *B41J 3/4078* (2013.01); *B41J 2002/14241* (2013.01); *B41J 2002/14419* (2013.01)

(58) Field of Classification Search
CPC ..... B41J 2/04515; B41J 2/04596; B41J 2/04581; B41J 2/04541; B41J 2/0455
See application file for complete search history.

(56) References Cited

U.S. PATENT DOCUMENTS 6,371,587 B1 * 4/2002 Chang ..... B41J 2/04541 310/316.01
2006/0197806 A1 9/2006 Komatsu
2009/0213152 A1 8/2009 Tabata et al.
2011/0261101 A1 10/2011 Drury et al.
(Continued)

FOREIGN PATENT DOCUMENTS

EP 0974464 A2 1/2000
EP 3069881 A2 9/2016
(Continued)

OTHER PUBLICATIONS

The Extended European Search Report for the corresponding European Patent Application No. 18191103.3 dated Jan. 21, 2019.

*Primary Examiner* — Scott A Richmond
(74) *Attorney, Agent, or Firm* — Global IP Counselors, LLP

(57) ABSTRACT

There is provided a liquid ejecting apparatus including: a first switching circuit is switched so that a first voltage waveform is supplied to a first piezoelectric element corresponding to a first nozzle which ejects the liquid, a second switching circuit is switched so that a second voltage waveform is supplied to a second piezoelectric element corresponding to a second nozzle which does not eject the liquid, and a third switching circuit is switched so that none of a plurality of voltage waveforms is supplied to a third piezoelectric element corresponding to the third nozzle which does not eject the liquid.

6 Claims, 16 Drawing Sheets

(56) References Cited

U.S. PATENT DOCUMENTS

| | | | | |
|---|---|---|---|---|
| 2014/0036007 | A1* | 2/2014 | Sasaki | B41J 2/175 347/85 |
| 2016/0167368 | A1 | 6/2016 | Sano | |
| 2017/0087828 | A1 | 3/2017 | Hayashi et al. | |
| 2018/0111368 | A1 | 4/2018 | Chikamoto | |
| 2019/0092004 | A1 | 3/2019 | Chikamoto | |

FOREIGN PATENT DOCUMENTS

| | | | |
|---|---|---|---|
| JP | 2016-179575 | A | 10/2016 |
| JP | 2019-059153 | A | 4/2019 |

* cited by examiner

| (SIH, SIL) | Ta | | |
|---|---|---|---|
| | Sa | Sb | Sc |
| (1, 1) [LARGE DOT] | H | L | L |
| (1, 0) [SMALL DOT] | L | H | L |
| (0, 1) [MICRO-VIBRATION] | L | L | H |
| (0, 0) [NON-OPERATION] | L | L | L |

| (SIH, SIL) | T1 | T2 | T3 |
|---|---|---|---|
| | S | | |
| (1, 1) [LARGE DOT] | H | L | L |
| (1, 0) [SMALL DOT] | L | H | L |
| (0, 1) [MICRO-VIBRATION] | L | L | H |
| (0, 0) [NON-OPERATION] | L | L | L |

LIQUID EJECTING APPARATUS

This application claims priority to Japanese Patent Application No. 2017-163416 filed on Aug. 28, 2017. The entire disclosure of Japanese Patent Application No. 2017-163416 is hereby incorporated herein by reference.

BACKGROUND

1. Technical Field

The present invention relates to a liquid ejecting apparatus.

2. Related Art

An ink jet printer, which ejects a liquid such as an ink to print an image or a document, is known to use a piezoelectric element (for example, piezo element). The piezoelectric element is provided in accordance with each of a plurality of nozzles in a print head. By driving each of the plurality of nozzles according to a driving signal, the nozzle ejects a predetermined amount of the liquid at a predetermined timing to form a dot on a medium.

It is necessary to increase density of the nozzles of the print head which ejects the liquid so that the ink jet printer performs a highly delicate print with high quality of 600 dpi or more. Specifically, in a case of a line type ink jet printer, the density of the nozzles arranged in a line shape requires the density of the nozzles equal to or more than 600 per inch so as to perform a print of 600 dpi. In a case where a serial type ink jet printer performs the print by a reciprocating motion, the density of the nozzles equal to or more than 300 per inch is required.

As a technology of increasing the density of the nozzles, JP-A-2016-179575 discloses a technology of directly mounting a driving IC for driving the piezoelectric element on an actuator substrate including a flow path and the piezoelectric element.

By the way, as the nozzles arranged in the print head are densified, the number of the nozzles per unit area increases and accordingly a heating value per unit area of the driving IC constituting the print head also increases. For this reason, improvement of cooling efficiency and reduction of heating in the driving IC are required. However, in a structure in which the driving ICs are arranged on the piezoelectric elements in JP-A-2016-179575, since the piezoelectric element and the driving IC are arranged in a space of an almost closed state so as to prevent a malfunction due to adhesion of the liquid to the piezoelectric element and the driving IC, it is difficult to cool the driving IC by air cooling. A main path of heat dissipation in such a configuration cannot but depend on heat dissipation by heat conduction to the peripheral structure in which the driving ICs are arranged.

For this reason, in a case where the flow path of the liquid is provided in a structure forming the space, it is possible to dissipate heat generated in the driving IC through the liquid. However, when the heating value of the driving IC exceeds heat dissipation amount which can be dissipated from the liquid, a temperature of the liquid flowing through the flow path increases according to heating of the driving IC, viscosity or the like of the liquid is changed according to the temperature rise of the liquid, and even if the piezoelectric element is driven in the same manner, there is a possibility that the ejection amount fluctuates according to a change in viscosity and ejection accuracy deteriorates.

SUMMARY

An advantage of some aspects of the invention is to provide a liquid ejecting apparatus capable of reducing heat of a driving IC.

The invention can be realized in the following aspects or application examples.

Application Example 1

According to this application example, there is provided a liquid ejecting apparatus including: a nozzle row that includes a plurality of nozzles which includes a first nozzle which ejects a liquid by driving a first piezoelectric element, a second nozzle which ejects the liquid by driving a second piezoelectric element, and a third nozzle which ejects the liquid by driving a third piezoelectric element; a driving circuit that generates a plurality of voltage waveforms which include a first voltage waveform for driving the piezoelectric element so as to eject the liquid from the nozzle included in the nozzle row and a second voltage waveform which drives the piezoelectric element to such an extent that the liquid is not ejected from the nozzle included in the nozzle row; a switching IC that includes a plurality of switching circuits which include a first switching circuit which switches whether or not to supply the voltage waveform to the first piezoelectric element, a second switching circuit which switches whether or not to supply the voltage waveform to the second piezoelectric element, and a third switching circuit which switches whether or not to supply the voltage waveform to the third piezoelectric element; and a protective substrate that is provided with the switching IC and is disposed so as to electrically connect the first switching circuit and the first piezoelectric element, to transmit the voltage waveform, and to protect the first piezoelectric element, in which the first switching circuit is switched so that the first voltage waveform is supplied to the first piezoelectric element corresponding to the first nozzle which ejects the liquid, the second switching circuit is switched so that the second voltage waveform is supplied to the second piezoelectric element corresponding to the second nozzle which does not eject the liquid, and the third switching circuit is switched so that none of the plurality of voltage waveforms is supplied to the third piezoelectric element corresponding to the third nozzle which does not eject the liquid.

In this configuration, the liquid ejecting apparatus includes the switching IC that includes the plurality of switching circuits which switch whether or not to supply the voltage waveform to the corresponding piezoelectric element. Among the plurality of switching circuits, the first switching circuit is switched so that the first voltage waveform for driving the piezoelectric element for ejecting the liquid is supplied to the first piezoelectric element corresponding to the first nozzle which ejects the liquid, the second switching circuit is switched so that the second voltage waveform for driving the piezoelectric element for not ejecting the liquid is supplied to the second piezoelectric element corresponding to the second nozzle which does not eject the liquid, and the third switching circuit is switched so that none of the plurality of voltage waveforms is supplied to the third piezoelectric element corresponding to the third nozzle which does not eject the liquid. In this way, the plurality of nozzles included in the nozzle row include the first nozzle which ejects the liquid, and the second nozzle and the third nozzle which do not eject the liquid. Among the second nozzle and the third nozzle which do not eject the liquid, none of the plurality of voltage waveforms is supplied to the third piezoelectric element corresponding to the third nozzle. Accordingly, since a current and a voltage are not generated as the voltage waveform is supplied to the third piezoelectric element, heat generated in the third switching circuit of the switching IC is reduced. Therefore, the heat of the switching IC including the third switching circuit can be reduced.

Application Example 2

In the liquid ejecting apparatus according to the application example, the first switching circuit may include a plurality of switches that include a first switch which switches whether or not to supply the first voltage waveform to the first piezoelectric element, and a second switch which switches whether or not to supply the second voltage waveform to the first piezoelectric element.

In this configuration, the first switching circuit includes the first switch and the second switch. By the first switch and the second switch, the first switching circuit can switch whether to selectively supply each of the plurality of voltage waveforms which include the first voltage waveform and the second voltage waveform to the first piezoelectric element or to supply none of the plurality of voltage waveforms to the first piezoelectric element. Accordingly, it is possible to eject (or not eject) the amount of the liquid corresponding to each of the plurality of voltage waveforms from the first nozzle, thereby it is possible to improve versatility of the first nozzle.

Application Example 3

In the liquid ejecting apparatus according to the application example, the plurality of voltage waveforms may include a third voltage waveform that drives the piezoelectric element so as to eject a small amount of the liquid as compared with a case of supplying the first voltage waveform, and the first switching circuit may include a third switch that switches whether or not to supply the third voltage waveform to the first piezoelectric element.

In this configuration, by providing the third voltage waveform which drives the piezoelectric element so as to eject the different amounts of the liquid, it is possible to eject the amount of the liquid corresponding to middle gradation. Accordingly, it is possible to express high gradation.

Application Example 4

In the liquid ejecting apparatus according to the application example, the nozzle row may be provided with the nozzles at density of 300 or more per inch.

In this configuration, since the voltage waveform is not supplied to the piezoelectric elements corresponding to some of the nozzles which do not eject the liquid even if the nozzle row is provided with the nozzles at density of 300 or more per inch, it is possible to reduce a temperature rise of the switching IC. Further, by controlling the nozzles corresponding to the piezoelectric elements to which the voltage waveform is not supplied so as to be arranged approximately evenly in the nozzle row, even in a case of the nozzle row provided with the nozzles at density of 300 or more per inch, it is possible to reduce concentration of the heat in the switching IC.

Application Example 5

In the liquid ejecting apparatus according to the application example, the switching IC may have a shape which includes a short side and a long side intersected with the short side, and a length of the long side may be equal to or larger than 10 times a length of the short side.

In this configuration, since the voltage waveform is not supplied to the piezoelectric elements corresponding to some of the nozzles which do not eject the liquid, even if the switching IC has a shape which includes the short side and the long side having the length equal to or larger than 10 times the length of the short side, it is possible to reduce the temperature rise of the switching IC. Further, by controlling the switching circuits corresponding to the piezoelectric elements to which the voltage waveform is not supplied so as to be arranged approximately evenly in the switching IC, even if the switching IC has a shape which includes the short side and the long side having the length equal to or larger than 10 times the length of the short side, it is possible to reduce concentration of the heat in the switching IC.

Application Example 6

The liquid ejecting apparatus according to the application example may be an industrial ink jet printer.

"Industrial ink jet printer" means a printer (manufacturing apparatus) used for manufacturing an organic electro-luminescence (OEL) device, a color filter for a liquid crystal, or the like by a droplet ejecting method. The industrial ink jet printer is mainly used for manufacturing industrial products such as a liquid crystal color filter and an organic electro-luminescence device, and the like and is required to have ejection weight accuracy, enlargement for improving productivity, miniaturization for improving concentration of finished products (high resolution of ejecting unit), or the like. Further, as mass production of the same industrial product, it is assumed that the liquid is not ejected from the specific nozzle. In this configuration, since the liquid ejecting apparatus includes the nozzle which ejects the liquid by supplying the voltage waveform, the nozzle which does not eject the liquid and stirs the liquid even by supplying the voltage waveform, and the nozzle which does not eject the liquid without supplying the voltage waveform, it is possible to reduce the heat of the switching IC. Further, for example, by controlling the nozzles to which the voltage waveform is not supplied so as not to concentrate the nozzles in the nozzle row, it is also possible to reduce concentration of heating points in the switching IC. For this reason, when the liquid ejecting apparatus is used as the industrial ink jet printer, a large effect can be obtained.

Application Example 7

The liquid ejecting apparatus according to the application example may be a textile ink jet printer.

"Textile ink jet printer" means an ink jet printer which performs printing on a fabric, or sublimation-transfers an image printed on a medium and performs printing on the fabric. The textile ink jet printer is mainly used for a purpose of producing small quantities of various types and high speed on-demand supply of products, and is used for providing a fabric in accordance with customer needs. For this reason, a highly delicate print with high quality is required and the density of the nozzles becomes higher. Therefore, since the switching IC becomes longer or the number of the nozzles becomes larger, the heat of the switching IC becomes larger. In this configuration, since the ejecting unit which does not operate so as to reduce the temperature rise of the switching IC is provided, it is also possible to reduce the heat of the switching IC. For this reason, when the liquid ejecting apparatus is used as the textile ink jet printer, a large effect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to drawings. The used drawings are for convenience of explanation. The embodiments to be described below do not unfairly limit contents of the invention described in the claims. Further, not all of configurations described hereinafter are essential configuration requirements of the invention.

Hereinafter, as an example of a liquid ejecting apparatus according to the invention, an ink jet printer will be described.

1. First Embodiment

1.1 Configuration of Ink Jet Printer

Figure 1:
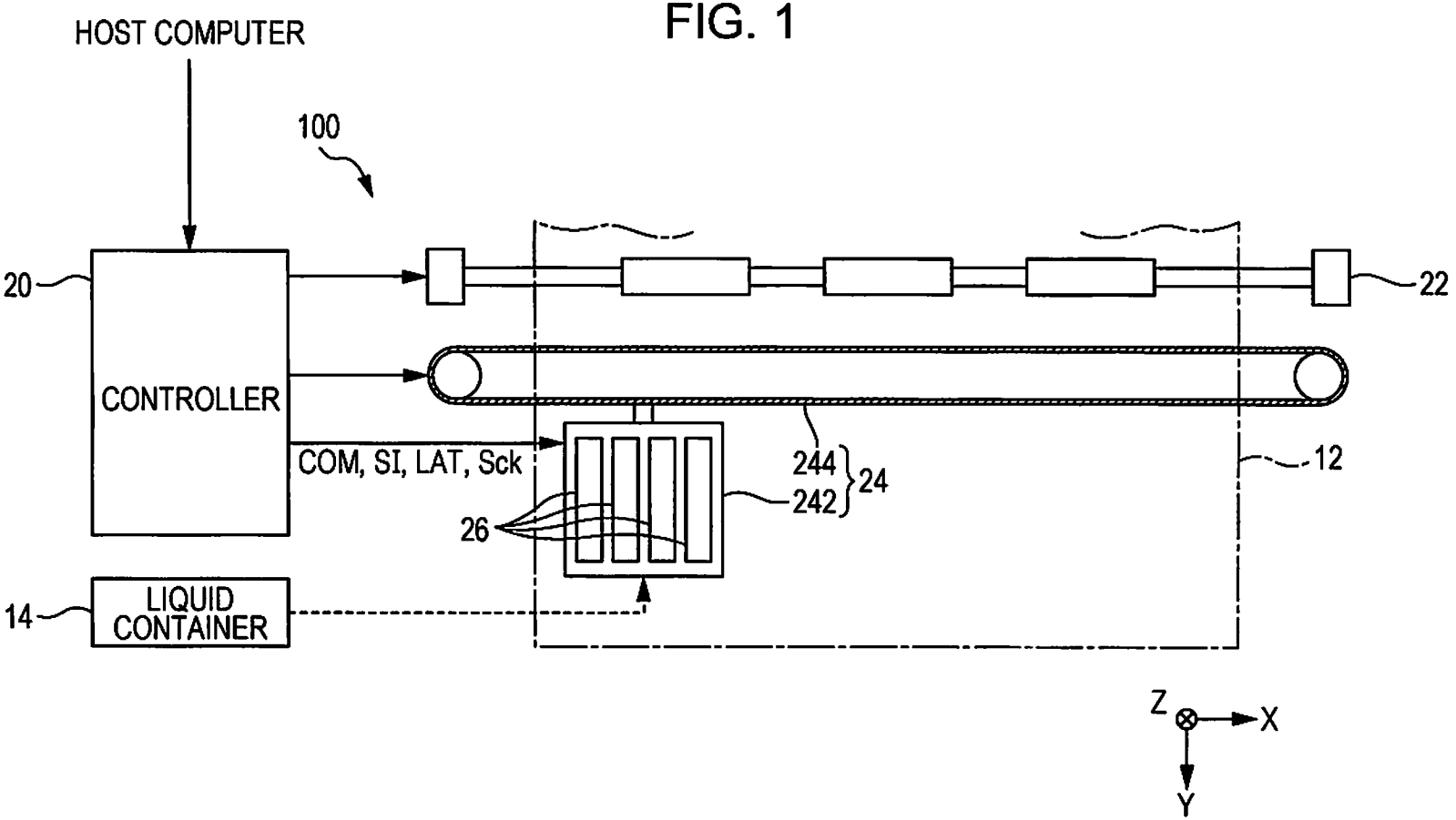
FIG. 1 is a block diagram schematically illustrating an ink jet printer according to a first embodiment.

FIG. 1 is a configuration diagram illustrating an ink jet printer 100 according to the first embodiment. The ink jet printer 100 according to the first embodiment performs print by ejecting an ink which is an example of a liquid to a medium 12 and forming a dot. The medium 12 is typically printing paper, but as the medium 12, a predetermined printing target such as a resin film or a fabric can be used.

As illustrated in FIG. 1, the ink jet printer 100 includes a liquid container 14 which stores the ink. For example, as the liquid container 14, a cartridge detachable from the ink jet printer 100, an ink pack in a bag shape formed of a flexible film, an ink tank which can supplement the ink, or the like can be adopted. The liquid container 14 stores plural kinds of inks having different colors.

As illustrated in FIG. 1, the ink jet printer 100 includes a controller 20, a transport unit 22, a moving unit 24, and a plurality of print heads 26.

The controller 20 includes, for example, a processing circuit such as a central processing unit (CPU) or a field programmable gate array (FPGA) and a storage circuit such as a semiconductor memory and controls each of elements of the ink jet printer 100 based on information input from an external apparatus such as a host computer. In the first embodiment, the transport unit 22 transports the medium 12 in the +Y direction by control of the controller 20. Hereinafter, in some cases, the +Y direction and the −Y direction opposite to the +Y direction are referred to as a Y-axis direction.

The controller 20 controls the moving unit 24 so that the plurality of print heads 26 reciprocates in the +X direction and in the −X direction opposite to the +X direction. Here, the +X direction is a direction intersected with (typically orthogonal to) the +Y direction in which the medium 12 is transported. Hereinafter, in some cases, the +X direction and the −X direction are referred to as an X-axis direction. The moving unit 24 includes a carriage 242 in an approximate box shape which accommodates the plurality of print heads 26 and an endless belt 244 to which the carriage 242 is fixed. The liquid container 14 can be mounted on the carriage 242 along with the print head 26.

The ink is supplied to each of the plurality of print heads 26 from the liquid container 14. In addition, the controller 20 inputs a plurality of driving signals COM (driving signals COM1, COM2, and COM3) for driving the print head 26, a print data signal SI for controlling the print head 26, a latch signal LAT for controlling an ejection timing, and a clock signal Sck, to each of the plurality of print heads 26. Each of the plurality of print heads 26 is driven by the driving signal COM and ejects the ink from some or all of nozzles of 2M (M is natural number equal to or more than one) in the +Z direction by control of the print data signal SI.

Here, the +Z direction is a direction intersected with (typically orthogonal to) the +X direction and the +Y direction. Hereinafter, in some cases, the +Z direction and the −Z direction opposite to the +Z direction are referred to as a Z-axis direction. The medium 12 is transported and the carriage 242 reciprocates by the transport unit 22. In conjunction with the medium 12 and the carriage 242, each of the print heads 26 ejects the ink from some or all of the nozzles of 2M and lands the ejected ink on a surface of the medium 12 to form a desired image on the surface of the medium 12.

1.2 Configuration of Controller and Print Head

Figure 2:
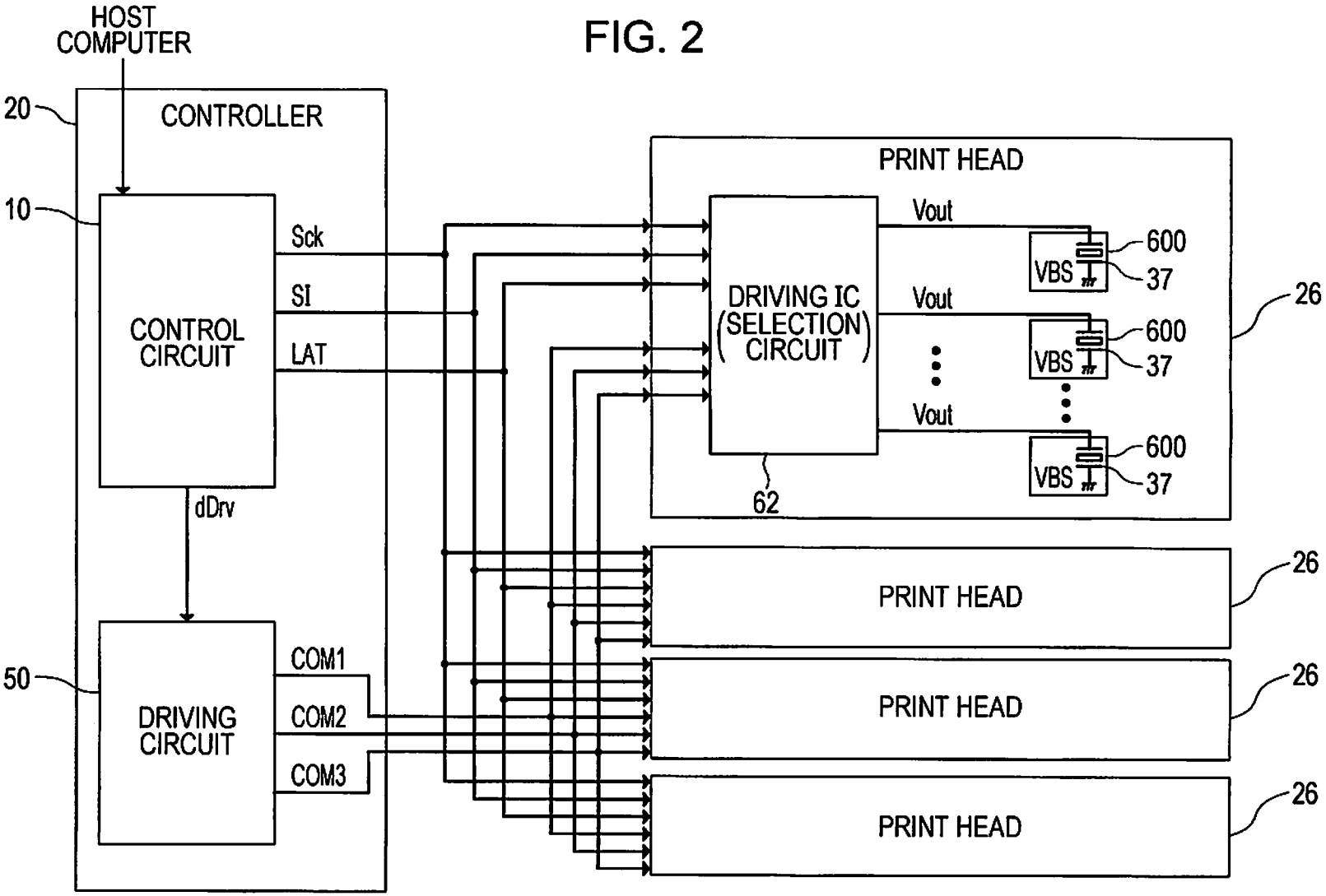
FIG. 2 is a block diagram illustrating a configuration of a controller and a print head according to the first embodiment.

FIG. 2 is a block diagram illustrating a configuration of the controller 20 and the print head 26 of the ink jet printer 100 according to the first embodiment. The controller 20 and the print head 26 are electrically connected with each other by a flexible flat cable or the like.

The controller 20 includes a control circuit 10 and a driving circuit 50. When various kinds of signals such as image data are supplied from the host computer, the control circuit 10 outputs various kinds of control signals and the like for controlling each of units.

Specifically, based on various kinds of the signals from the host computer, the control circuit 10 generates the print data signal SI, the latch signal LAT, the clock signal Sck, and the like as plural kinds of control signals for controlling ejection of the ink from an ejecting unit 600 included in the print head 26 and outputs the print data signal SI, the latch signal LAT, the clock signal Sck, and the like to the print head 26. The plural kinds of control signals may include some of the signals or may include another signal.

In addition, based on various kinds of the signals from the host computer, the control circuit 10 generates digital data dDrv which is a source of the driving signal for driving the print head 26 and outputs the digital data dDrv to the driving circuit 50. The digital data dDrv is digital data obtained by analog-to-digital conversion of a voltage waveform which is a source of the driving signal for driving the print head 26. The digital data dDrv may be digital data indicating a difference with direct driving data or may be digital data which defines a corresponding relationship between a length in each of sections in which a slope is constant and the slope in each of the sections in the voltage waveform. The digital data dDrv may include data of a plurality of voltage waveforms. In addition, the digital data dDrv may output a plurality of pieces of digital data to the driving circuit 50 in parallel.

The driving circuit 50 generates the plurality of voltage waveforms based on the digital data dDrv and outputs the voltage waveform to the print head 26 in serial or in parallel. For example, the driving circuit 50 may generate each of the driving signals COM1, COM2, and COM3 in serial or in parallel by the voltage waveform obtained by D-class amplification after digital-to-analog conversion of the digital data dDrv corresponding to each of the plurality of voltage waveforms or may generate each of the driving signals COM1, COM2, and COM3 by the voltage waveform obtained by AB-class amplification after digital-to-analog conversion of the digital data dDrv.

In this way, each of the driving signals COM1, COM2, and COM3 is a signal which includes the voltage waveform for driving the print head 26. In the first embodiment, the driving signal COM1 is a signal which includes a voltage waveform Adp (example of "first voltage waveform", see FIG. 5) supplied (applied) to a piezoelectric element 37 included in the print head 26. The driving signal COM2 is a signal which includes a voltage waveform Bdp (example of "third voltage waveform", see FIG. 5) supplied (applied) to the piezoelectric element 37 included in the print head 26. The driving signal COM3 is a signal which includes a voltage waveform Cdp (example of "second voltage waveform", see FIG. 5) supplied (applied) to the piezoelectric element 37 included in the print head 26.

In the first embodiment, the driving circuit 50 generates and outputs three kinds of the driving signals COM1, COM2, and COM3. For this reason, the digital data dDrv includes data of the voltage waveform for generating the three kinds of the driving signals. The driving circuit 50 may include the driving circuit 50 corresponding to each of the three kinds of the driving signals COM1, COM2, and COM3 generated based on the data of three kinds of the voltage waveforms.

The plural kinds of control signals which includes the print data signal SI, the latch signal LAT, and the clock signal Sck and the three kinds of the driving signals COM1, COM2, and COM3 are input to each of the plurality of print heads 26. Since the plurality of print heads 26 have the same configurations, one print head will be described as a representative. In addition, FIG. 2 illustrates the four print heads 26, but the print heads 26 equal to or more than five or equal to or less than three may be provided.

The print head 26 include a plurality of ejecting units 600 which include the piezoelectric element 37 and eject the ink by driving of the piezoelectric element 37 and the driving IC 62 which generates a driving signal Vout which drives the piezoelectric element 37 included in each of the plurality of ejecting units 600.

The plural kinds of control signals which includes the print data signal SI, the latch signal LAT, and the clock signal Sck and the three kinds of the driving signals COM1, COM2, and COM3 are input to the driving IC 62. The driving IC 62 generates the driving signal Vout by controlling whether one of the three kinds of the driving signals COM1, COM2, and COM3 corresponding to each of the plurality of ejecting units 600 based on the print data signal SI at a timing based on the latch signal LAT synchronized with the clock signal Sck is output or none of the three kinds of the driving signals COM1, COM2, and COM3 is output.

The driving signal Vout generated by the driving IC 62 is supplied to one end of the piezoelectric element 37 of each of the plurality of ejecting units 600 and a constant voltage signal VBS is supplied to the other end of the piezoelectric element 37.

1.3 Configuration of Print Head

Figure 3:
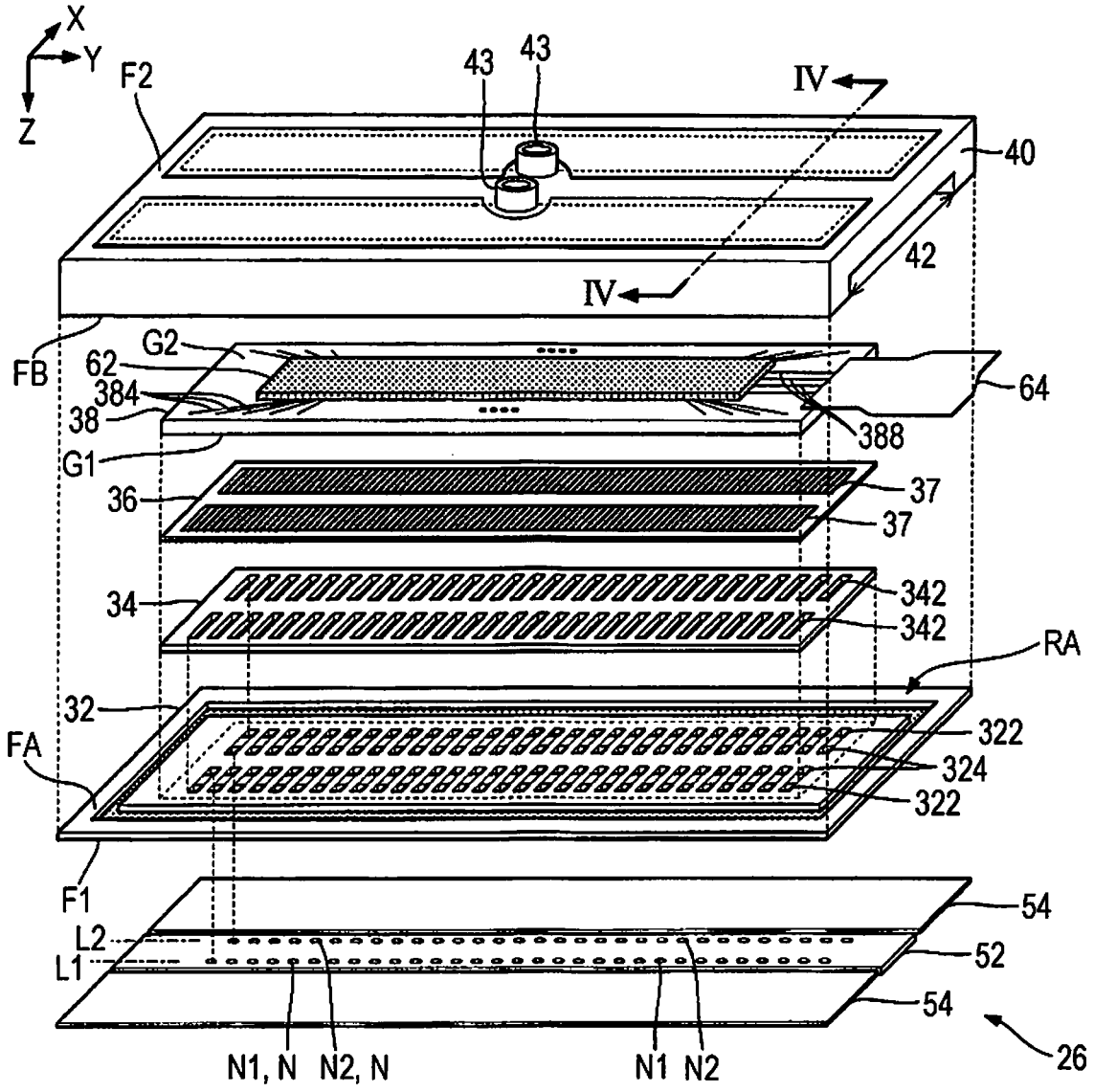
FIG. 3 is an exploded perspective view illustrating the print head.

Here, a configuration of the print head 26 will be described. FIG. 3 is an exploded perspective view illustrating the print head 26 and FIG. 4 is a cross-sectional view taken along the line IV-IV in FIG. 3.

As illustrated in FIG. 3, the print head 26 includes nozzles N of 2M arranged in the Y-axis direction. In the first embodiment, the nozzles N of 2M form two nozzle rows divided into two rows of a row L1 and a row L2. Hereinafter, in some cases, each of the nozzles N of M which belong to the row L1 is referred to as a nozzle N1 and each of the nozzles N of M which belong to the row L2 is referred to as a nozzle N2. In addition, as an example, it is assumed that positions in the Y-axis direction of the m-th nozzle N1 among the nozzles N1 of M which belong to the row L1 and the m-th nozzle N2 among the nozzles N2 of M which belong to the row L2 approximately match (m is natural number satisfying $1 \leq m \leq M$). Here, "positions approximately match" means that not only a case where the positions completely match but also a case where the positions can be regarded as the same considering an error is included. The nozzles N of 2M may be disposed in a so-called staggered shape so that the positions in the Y-axis direction of the m-th nozzle N1 among the nozzles N1 of M which belong to the row L1 and the m-th nozzle N2 among the nozzles N2 of M which belong to the row L2 are different.

Figure 4:
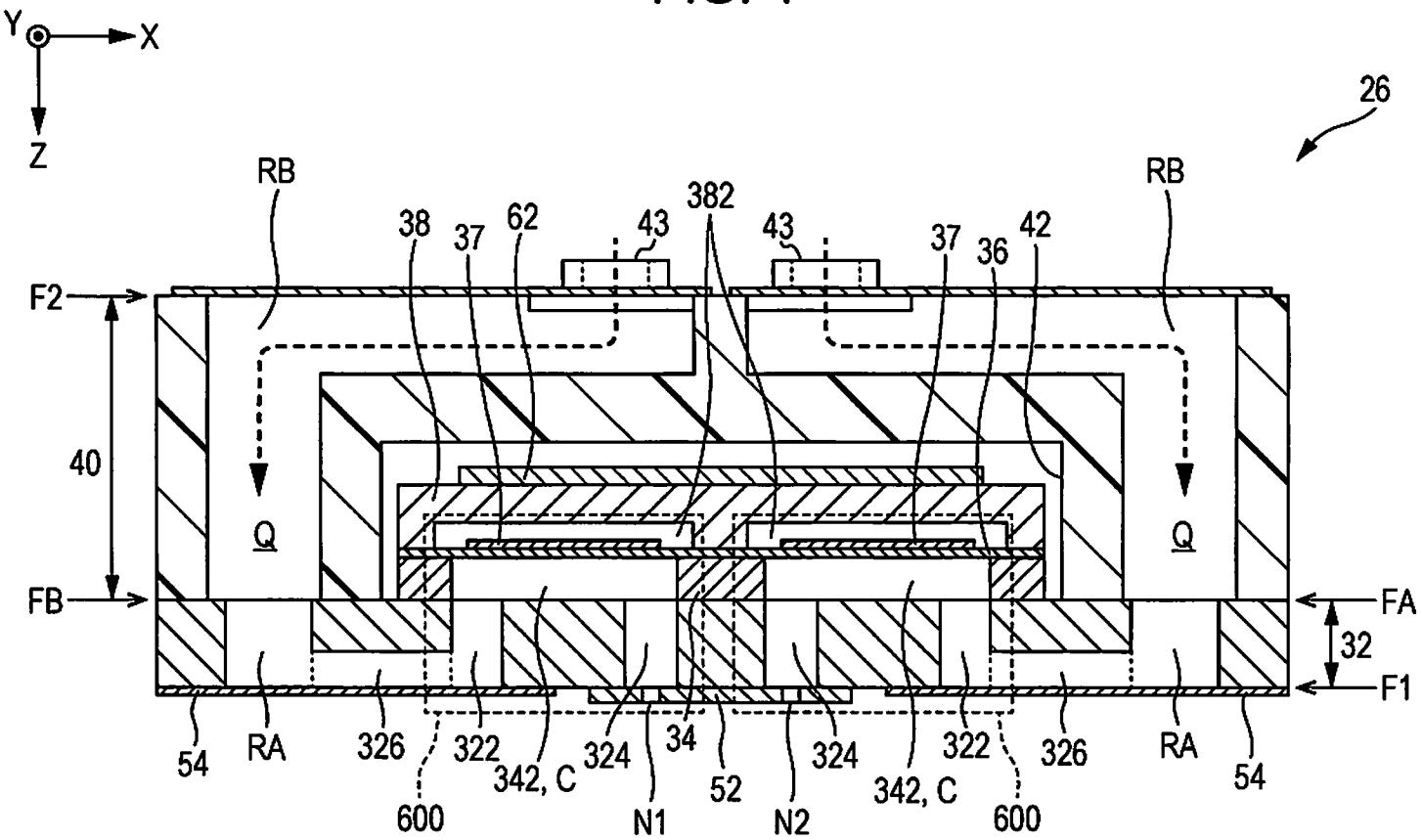
FIG. 4 is a cross-sectional view taken along the line IV-IV in FIG. 3.

As illustrated in FIGS. 3 and 4, the print head 26 includes a flow path substrate 32. The flow path substrate 32 is a plate member which includes a surface F1 and a surface FA. The surface F1 is a surface on a side of the medium 12 as viewed from the print head 26 and the surface FA is a surface opposite to the surface F1. A pressure chamber substrate 34, a vibrating unit 36, a plurality of piezoelectric elements 37, a protective substrate 38, and a casing unit 40 are provided on the surface FA. A nozzle substrate 52 and a vibration absorber 54 are provided on the surface F1. Each of elements of the print head 26 is approximately a plate member elongated in the Y-axis direction. Each of structures is stacked in the Z-axis direction and bonds one another by using, for example, an adhesive.

The nozzle substrate 52 is a plate member. The nozzles N of 2M which are through-holes are formed on the nozzle substrate 52. It is assumed that the nozzles N of M corresponding to each of the rows L1 and L2 are provided at density of 300 or more per inch in the nozzle substrate 52.

The flow path substrate 32 is a plate member for forming the flow path of the ink. As illustrated in FIGS. 3 and 4, a flow path RA is formed on the flow path substrate 32. In addition, flow paths 322 of 2M and flow paths 324 of 2M are formed on the flow path substrate 32 so as to correspond to the nozzles N of 2M in a one-to-one manner. As illustrated in FIG. 4, the flow path 322 and the flow path 324 are openings formed so as to penetrate through the flow path substrate 32. The flow path 324 communicates with the nozzle N corresponding to the flow path 324. In addition, two flow paths 326 are formed on the surface F1 of the flow path substrate 32. One of the two flow paths 326 is a flow path which communicates with the flow paths 322 of M corresponding to the nozzles N1 of M which belong to the flow path RA and the row L1 in a one-to-one manner. The other of the two flow paths 326 is a flow path which communicates with the flow paths 322 of M corresponding to the nozzles N2 of M which belong to the flow path RA and the row L2 in a one-to-one manner.

As illustrated in FIGS. 3 and 4, the pressure chamber substrate 34 is a plate member on which openings 342 of 2M are formed so as to corresponding to the nozzles N of 2M in a one-to-one manner. The vibrating unit 36 is provided on a surface opposite to the flow path substrate 32 in the pressure chamber substrate 34. The vibrating unit 36 is a plate member capable of vibrating.

As illustrated in FIG. 4, the vibrating unit 36 and the surface FA of the flow path substrate 32 are opposed to each other with an interval inside each of the openings 342. A space located between the surface FA of the flow path substrate 32 and the vibrating unit 36 inside the opening 342 functions as a pressure chamber C for applying pressure to the ink filled in the space. The pressure chamber C is, for example, a space having the X-axis direction as a longitudinal direction and the Y-axis direction as a transverse direction. The pressure chambers C of 2M are provided on the print head 26 so as to correspond to the nozzles N of 2M in a one-to-one manner. The pressure chamber C provided in accordance with the nozzle N1 communicates with the flow path RA via the flow path 322 and the flow path 326 and communicates with the nozzle N1 via the flow path 324. In addition, the pressure chamber C provided in accordance with the nozzle N2 communicates with the flow path RA via the flow path 322 and the flow path 326 and communicates with the nozzle N2 via the flow path 324.

As illustrated in FIGS. 3 and 4, the piezoelectric elements 37 of 2M are provided on a surface opposite to the pressure chamber C in the vibrating unit 36 so as to correspond to the pressure chambers C of 2M in a one-to-one manner. The driving signal Vout based on the plurality of driving signals COM is supplied to one end of the piezoelectric element 37 and the constant voltage signal VBS is supplied to the other end of the piezoelectric element 37. The piezoelectric element 37 is deformed (driven) according to a potential difference between the driving signal Vout and the constant voltage signal VBS. The vibrating unit 36 vibrates in conjunction with deformation of the piezoelectric element 37 and when the vibrating unit 36 vibrates, pressure in the pressure chamber C fluctuates. Then, the pressure in the pressure chamber C fluctuates, so that the ink filled in the pressure chamber C is ejected via the flow path 324 and the nozzle N. In the first embodiment, it is assumed that the piezoelectric element 37 can vibrate so that the driving signal Vout causes the ink to be ejected from the nozzle N 30000 or more times per second.

As illustrated in FIG. 4, the pressure chamber C, the flow paths 322 and 324, the nozzle N, the vibrating unit 36, and the piezoelectric element 37 are function as the ejecting unit 600 for ejecting the ink filled in the pressure chamber C by driving of the piezoelectric element 37. That is, the plurality of ejecting units 600 are juxtaposed in two rows along the Y-axis direction in the print head 26.

As illustrated in FIGS. 3 and 4, the protective substrate 38 is a plate member for protecting the piezoelectric elements 37 of 2M formed on the vibrating unit 36 and is provided on a surface of the vibrating unit 36 or a surface of the pressure chamber substrate 34.

Two accommodating spaces 382 are formed on a surface G1 which is a surface on a side of the medium 12 as viewed from the print head 26 in the protective substrate 38. One of the two accommodating spaces 382 is a space for accommodating the piezoelectric elements 37 of M corresponding to the nozzles N1 of M. The other is a space for accommodating the piezoelectric elements 37 of M corresponding to the nozzles N2 of M. In a case where the protective substrate 38 is disposed on the ejecting unit 600, the accommodating space 382 functions as "protected space" sealed so as to prevent the piezoelectric element 37 from deteriorating due to influence of oxygen, moisture, or the like. A width (height) of the accommodating space 382 in the Z-axis direction is sufficiently large so that the piezoelectric element 37 and the protective substrate 38 do not contact with each other even when the piezoelectric element 37 is displaced. For this reason, even in the case where the piezoelectric element 37 is displaced, noise caused by the displacement of the piezoelectric element 37 is prevented from propagating to an outside of the accommodating space 382. The space for preventing the piezoelectric element 37 from deteriorating due to influence of oxygen, moisture, or the like may be, for example, the accommodating space 382 sealed by the protective substrate 38 as illustrated in FIG. 4. In addition, even in a case where an opening exists between the protective substrate 38 and the vibrating unit 36, the space for preventing the piezoelectric element 37 from deteriorating may be a space sealed by the casing unit 40 or the like. That is, the protective substrate 38 is disposed so as to protect the piezoelectric element 37.

The driving IC 62 is provided on a surface G2 which is a surface opposite to the surface G1 of the protective substrate 38. A plurality of control signals such as the print data signal SI, the latch signal LAT, the clock signal Sck, and the like input to the print head 26 and the plurality of driving signals COM are input to the driving IC 62. The driving IC 62 generates and outputs the driving signal Vout by switching whether or not to supply one of the plurality of driving signals COM to each of the piezoelectric elements 37 based on the print data signal SI. The driving IC 62 has a rectangular shape with a long side and a short side and the driving IC 62 in the first embodiment may have an elongated rectangular shape in which the long side is 10 times or more a length of the short side.

Wirings 384 of 2M are formed to be electrically connected to the driving IC 62 on the surface G2 of the protective substrate 38 so that the wirings 384 of 2M correspond to the piezoelectric elements 37 of 2M in a one-to-one manner. In detail, one end of the wiring 384 is electrically connected to an output of a switching circuit 230 (see FIG. 6) of the driving IC 62 described below. The other end is electrically connected to the piezoelectric element 37 via a through-hole which penetrates through the protective substrate 38. In this way, the driving signal Vout output from the driving IC 62 is transmitted to the wiring 384 wired to the protective substrate 38, the through-hole, and a terminal and is supplied to the piezoelectric element 37.

In addition, a plurality of wirings 388 are formed to be electrically connected to the driving IC 62 on the surface G2 of the protective substrate 38. A wiring member 64 is bonded to the plurality of wirings 388. The wiring member 64 is a member in which a plurality of wirings for transmitting a plurality of signals input to the print head 26 to the driving IC 62 are formed and may be, for example, a flexible printed circuit (FPC), a flexible flat cable (FFC), or the like. The wiring 388 transmits the control signals including the print data signal SI, the latch signal LAT, the clock signal Sck, and the like input from the wiring member 64, the plurality of driving signals COM including the plurality of voltage waveform, and the like, to the driving IC 62. In this way, the protective substrate 38 functions as a relay substrate on which the driving IC 62 is mounted and which transmits the signal for controlling driving of the piezoelectric element 37.

The casing unit 40 is a case for storing the ink to be supplied to the pressure chambers C of 2M. A surface FB which is a surface on a side of the medium 12 as viewed from the print head 26 in the casing unit 40 is fixed on the surface FA of the flow path substrate 32 by, for example, an adhesive. A concavity portion 42 in a groove shape extending in the Y-axis direction is formed on the surface FB of the casing unit 40. The protective substrate 38 and the driving IC 62 are accommodated in an inside of the concavity portion 42. At this time, the wiring member 64 is extended in the Y-axis direction so as to pass through the inside of the concavity portion 42.

The casing unit 40 is formed by, for example, injection molding of a resin material. As illustrated in FIG. 4, a flow path RB which communicates with the flow path RA is formed on the casing unit 40. The flow path RA and the flow path RB function as a reservoir Q which stores the ink to be supplied to the pressure chambers C of 2M.

Two inlets 43 for introducing the ink supplied from the liquid container 14 to the reservoir Q is provided on a surface F2 which is a surface opposite to the surface FB of the casing unit 40. The ink supplied from the liquid container 14 to the two inlets 43 flows into the flow path RA via the flow path RB. Then, a part of the ink flowing into the flow path RA is supplied to the pressure chamber C corresponding to the nozzle N via the flow path 326 and the flow path 322. The ink filled in the pressure chamber C corresponding to the nozzle N is ejected from the nozzle N via the flow path 324 by driving of the piezoelectric element 37 corresponding to the nozzle N.

1.4 Relationship between Heating of Driving IC and Heat Dissipation Through Ink

Generally, the plurality of driving signals COM for driving the piezoelectric element 37 are signals which include voltage waveforms with large amplitudes. For this reason, the driving IC 62 heats in a case where the driving signal COM is supplied to the piezoelectric element 37 as the driving signal Vout. Specifically, in the first embodiment, in a case where the piezoelectric element 37 vibrates so that the driving signal Vout causes the ink to be ejected from the nozzle N 30000 or more times per second, a heating value of the driving IC 62 becomes larger. In addition, as described in the first embodiment, in a case where the nozzle N and the piezoelectric element 37 are provided at density of 300 or more per inch in the print head 26, the heating value per unit area in the driving IC 62 also becomes larger. Further, as illustrated in FIGS. 3 and 4, in some cases, when the protective substrate 38 on which the driving IC 62 is provided is provided in a vicinity of the ejecting unit 600, since the driving IC 62 and the protective substrate 38 is disposed so as to be covered by the casing unit 40 and do not contact with outside air of the print head 26 (or contact area between driving IC 62 and protective substrate 38, and air outside print head 26 is reduced), efficiency of heat dissipation of the driving IC 62 is lowered and a temperature rises.

For this case, in the first embodiment, as illustrated in FIGS. 3 and 4, the driving IC 62 and the protective substrate 38 are arranged in a space surrounded by the reservoir Q and the pressure chamber C of the print head 26. For this reason, heat generated by the driving IC 62 can dissipate via the ink inside the reservoir Q and the pressure chamber C. Specifically, in a case where the ink is ejected from the nozzle N, a new ink is supplied from the liquid container 14 to the reservoir Q via the inlet 43 along with the ejection of the ink. For this reason, an increase in a temperature of the ink of the reservoir Q and the pressure chamber C is reduced and it is possible to efficiently dissipate the heat of the driving IC 62 via the ink. Further, the increase in the temperature of the ink of the reservoir Q and the pressure chamber C can be reduced.

On the other hand, in the ink jet printer 100, the driving signal Vout including the voltage waveform for driving the piezoelectric element 37 (hereinafter, referred to as "micro-vibration") to such an extent that the ink is not ejected from the nozzle N is supplied to the piezoelectric element 37 corresponding to the nozzle N from which the ink is not generally ejected. Accordingly, micro-vibration of the ink prevents an increase in viscosity of the ink in a vicinity of an opening portion of the nozzle N.

At this time, in the same manner as the case where the ink is ejected, since the voltage waveforms with large amplitudes is supplied to the piezoelectric element 37 as the driving signal Vout, the driving IC 62 heats. On the other hand, unlike the case where the ink is ejected, the new ink is not supplied from the liquid container 14 to the reservoir Q via the inlet 43. For this reason, when the micro-vibration is continuously performed on the specific nozzle N, the heat generated by the driving IC 62 is accumulated, and the accumulated heating value increases the heat dissipation amount via the ink inside the reservoir Q and the pressure chamber C, there is a possibility that a temperature of the driving IC 62 rises. Further, along with the heating of the driving IC 62, a temperature of the ink inside the reservoir Q and the pressure chamber C also rises and physical properties such as viscosity of the ink are changed as the temperature of the ink rises. Accordingly, even in a case where the same driving signal Vout is supplied to the piezoelectric element 37, there is a possibility that the ejection amount of the ink fluctuates and ejection accuracy deteriorates.

Here, in the first embodiment, the driving signal Vout is not supplied to some of the piezoelectric elements 37 corresponding to the nozzles N from which the ink is not ejected, that is, the piezoelectric element 37 is not micro-vibrated. Accordingly, it is possible to reduce the heat of the driving IC 62. Among the driving signals Vout supplied to the piezoelectric element 37, the driving signal Vout for driving the piezoelectric element 37 to such an extent that the ink is ejected from the ejecting unit 600 by driving of the piezoelectric element 37 and the driving signal Vout for driving the piezoelectric element 37 to such an extent that the ink is not ejected from the ejecting unit 600 by the driving of the piezoelectric element 37 may be, for example, the driving signals Vout based on the different voltage waveforms or may be the driving signals Vout having different times and frequencies supplied to the piezoelectric element based on the same voltage waveform. In the first embodiment, the driving signal Vout for driving the piezoelectric element 37 to such an extent that the ink is ejected from the ejecting unit 600 by driving of the piezoelectric element 37 and the driving signal Vout for driving the piezoelectric element 37 to such an extent that the ink is not ejected from the ejecting unit 600 by the driving of the piezoelectric element 37 will be described as the signals having the different voltage waveforms.

1.5 Electrical Configuration of Print Head

Here, an electrical configuration of the print head 26 will be described with reference to FIGS. 5 to 9.

As described above, the plural kinds of control signals which includes the print data signal SI, the latch signal LAT, and the clock signal Sck and the three kinds of the driving signals COM1, COM2, and COM3 are input to the driving IC 62 included in the print heads 26. The driving IC 62 supplies the driving signal Vout to the piezoelectric element 37 included in the ejecting unit 600 based on the input signal. Accordingly, the piezoelectric element 37 ejects the ink from the driven ejecting unit 600. First, by using FIG. 5, an example of the three kinds of the driving signals COM1, COM2, and COM3 and the plurality of voltage waveforms constituting the driving signals will be described, then the electrical configuration of the print head 26 will be described with reference to FIGS. 6 to 9.

In the first embodiment described below, the print data signal SI includes a signal for ejecting the ink from the ejecting unit 600 and a signal for not ejecting the ink from the ejecting unit 600. Further, the signal for not ejecting the ink from the ejecting unit 600 includes two kinds of signals of a signal for outputting the driving signal Vout for micro-vibration of the piezoelectric element 37 and a signal for not supplying the driving signal Vout to the piezoelectric element 37.

Specifically, the nozzle row includes a nozzle Na (example of "first nozzle") which ejects the ink (example of "liquid") by driving a piezoelectric element 37*a* (example of "first piezoelectric element"), a nozzle Nb (example of "second nozzle") which ejects the ink by driving a piezoelectric element 37*b* (example of "second piezoelectric element"), and a nozzle Nc (example of "third nozzle") which ejects the ink by driving a piezoelectric element 37*c* (example of "third piezoelectric element").

The driving circuit 50 generates the plurality of voltage waveform including the voltage waveform Adp (example of "first voltage waveform") for driving the piezoelectric element 37 so as to eject the ink from the nozzle N included in the nozzle row and the voltage waveform Cdp (example of "second voltage waveform") for driving the piezoelectric element 37 to such an extent that the ink is not ejected from the nozzle N.

The driving IC 62 (example of "switching IC") includes a plurality of switching circuits 230 which includes a switching circuit 230*a* (example of "first switching circuit"), a switching circuit 230*b* (example of "second switching circuit"), and a switching circuit 230*c* (example of "third switching circuit"). The switching circuit 230*a* switches whether or not to supply one of the plurality of voltage waveforms to the corresponding piezoelectric element 37*a*. The switching circuit 230*b* switches whether or not to supply one of the plurality of voltage waveforms to the corresponding piezoelectric element 37*b*. The switching circuit 230*c* switches whether or not to supply one of the plurality of voltage waveforms to the corresponding piezoelectric element 37*c*.

Then, in the print head 26, the driving IC 62 switches the switching circuit 230*a* so as to supply the voltage waveform Adp to the piezoelectric element 37*a* corresponding to the nozzle Na from which the ink is ejected, switches the switching circuit 230*b* so as to supply the voltage waveform Cdp to the piezoelectric element 37*b* corresponding to the nozzle Nb from which the ink is not ejected, and switches the switching circuit 230*c* so as not to supply any one of the plurality of voltage waveforms generated by the driving circuit 50 to the piezoelectric element 37*c* corresponding to the nozzle Nc from which the ink is not ejected.

In this way, the ink is ejected from some nozzles N (nozzles Na) among the nozzles N provided in the nozzle row of the print head 26 so as to perform the print on the medium 12. At this time, the driving signal Vout indicating the micro-vibration is supplied to the piezoelectric elements 37 corresponding to some nozzles N (nozzles Nb) among the nozzles N from which the ink is not ejected and the plurality of voltage waveforms generated by the driving circuit 50, that is, the driving signal Vout is not supplied to the piezoelectric elements 37 corresponding to the other nozzles N (nozzles Nc) among the nozzles N from which the ink is not ejected.

In addition, each of the plurality of switching circuits 230 may include a switch 234*a* (example of "first switch") which switches whether or not to supply the voltage waveform Adp to the piezoelectric element 37 and a switch 234*c* (example of "second switch") which switches whether or not to supply the voltage waveform Cdp to the piezoelectric element 37 among the plurality of voltage waveforms.

Accordingly, each of the plurality of switching circuits 230 can respectively switch whether to supply the voltage waveform Adp to the corresponding piezoelectric element 37 or to supply the voltage waveform Cdp to the corresponding piezoelectric element 37 by switching conduction and non-conduction of the switch 234*a* and the switch 234*c*.

Further, the driving circuit 50 may generate the voltage waveform Bdp (example of "third voltage waveform") for driving the piezoelectric element 37 so as to eject a small amount of the ink as compared with the case of supplying the voltage waveform Adp as the plurality of voltage waveforms and each of the plurality of switching circuits 230 may include a switch 234*b* (example of "third switch") which switches whether or not to supply the voltage waveform Cdp to the piezoelectric element 37.

In the first embodiment, three gradations of "large dot", "small dot" and "non-recorded (no dot)" are expressed by using the voltage waveforms Adp, Bdp, and Cdp. In order to express the three gradations, the three kinds of the driving signals COM1, COM2, and COM3 generated based on the voltage waveforms Adp, Bdp, and Cdp are prepared. During a unit period (printing cycle), the driving signals COM1, COM2, and COM3 are selected or not selected according to the gradation to be expressed and the selected driving signal is supplied to the piezoelectric element 37 as the driving signal Vout. As a method of ejecting the ink, in addition to a first method in the first embodiment, there are a method (second method) of forming one dot by ejecting an ink droplet two or more times during the printing cycle and combining the ejected ink droplets equal to or more than one and a method (third method) of forming two or more dots without combining the ink droplets equal to or more than two.

Figure 5:
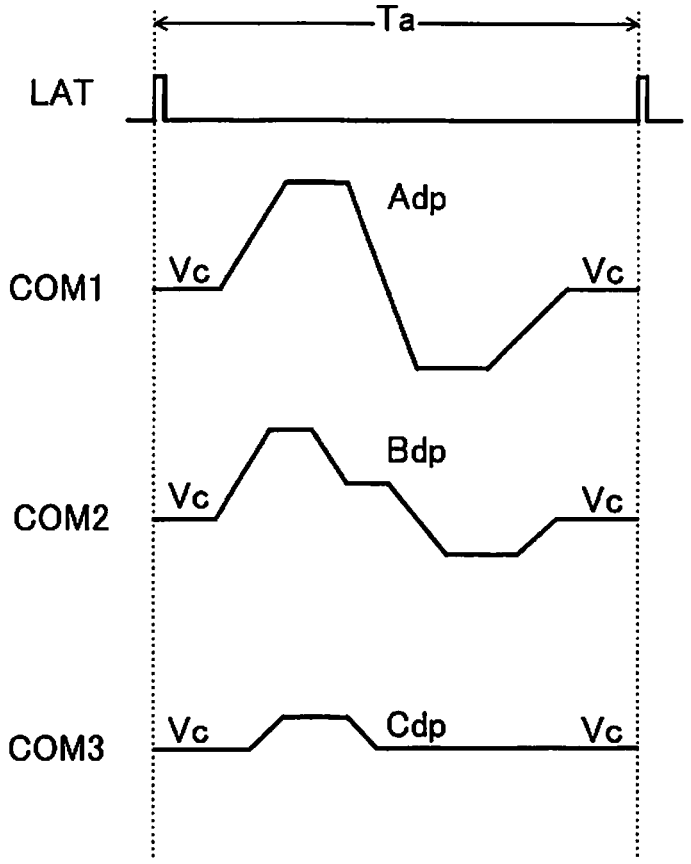
FIG. 5 is a diagram illustrating an example of driving signals.

FIG. 5 is a diagram illustrating an example of the driving signals COM1, COM2, and COM3 generated based on the voltage waveforms Adp, Bdp, and Cdp. As illustrated in FIG. 5, the driving signal COM1 is the voltage waveform Adp disposed in a cycle Ta from the rise of the latch signal LAT to the next rise of the latch signal LAT. The cycle Ta is the printing cycle and the driving signal COM1 forms a new dot on the medium 12 for each of the cycles Ta. Specifically, if the voltage waveform Adp is supplied to one end of the piezoelectric element 37, a predetermined amount, specifically, a large amount of the ink is ejected from the ejecting unit 600 (nozzle N) including the piezoelectric element 37.

The driving signal COM2 is the voltage waveform Bdp disposed during the cycle Ta. The driving signal COM2 forms a new dot on the medium 12 for each of the cycles Ta. Specifically, if the voltage waveform Bdp is supplied to one end of the piezoelectric element 37, the amount smaller than the predetermined amount, specifically, a small amount of the ink is ejected from the ejecting unit 600 (nozzle N) including the piezoelectric element 37.

The driving signal COM3 is the voltage waveform Cdp disposed during the cycle Ta. The voltage waveform Cdp is a waveform for micro-vibrating the piezoelectric element 37 to prevent an increase in viscosity of the ink in a vicinity of the nozzle N of the corresponding ejecting unit 600. For this reason, even if the voltage waveform Cdp is supplied to one end of the piezoelectric element 37, the ink droplet is not ejected from the nozzle N corresponding to the piezoelectric element 37. That is, the voltage waveform Cdp included in the driving signal COM3 is a waveform which drives (micro-vibrates) the piezoelectric element 37 so as not to eject the ink from the ejecting unit 600.

Figure 6:
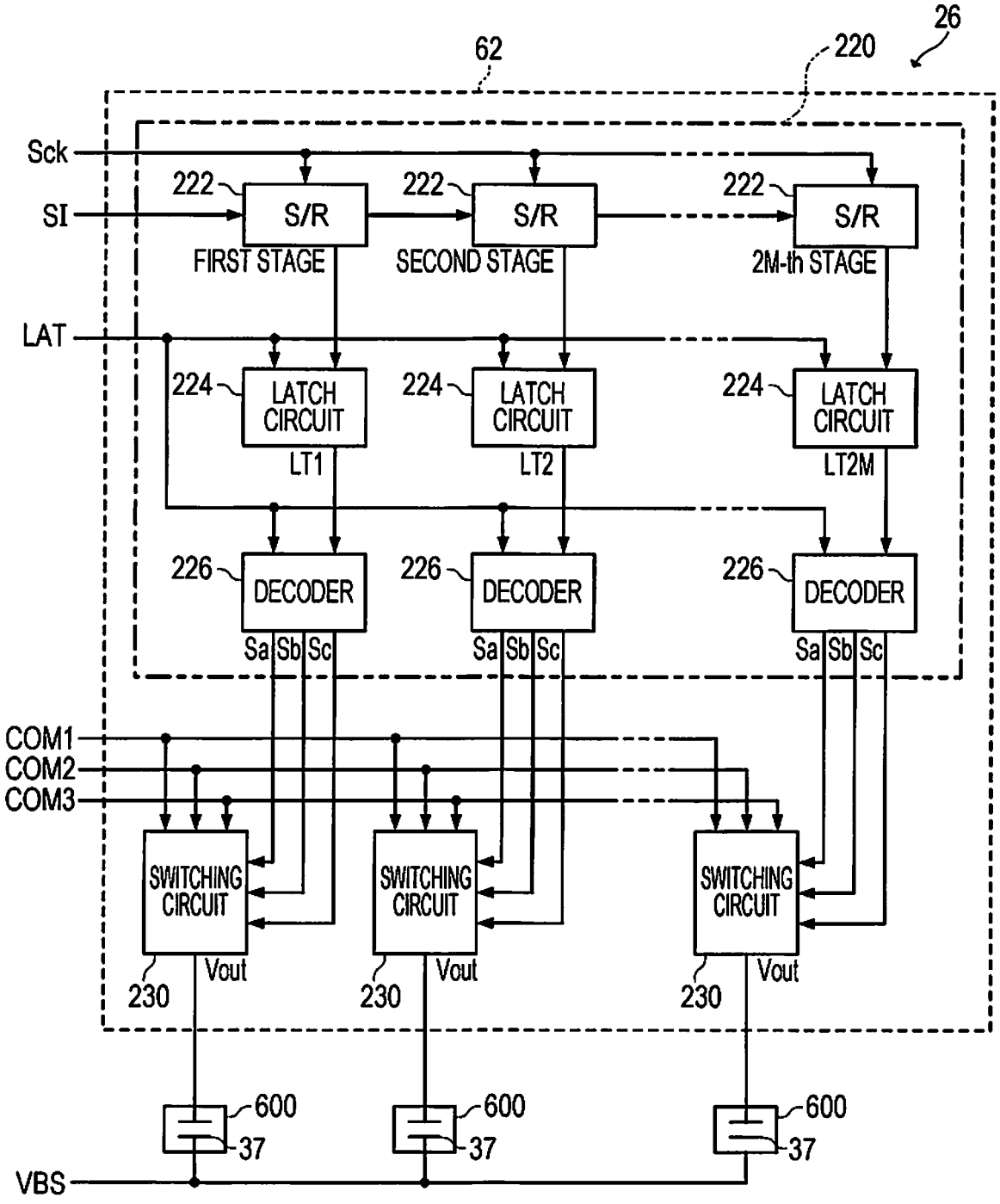
FIG. 6 is a block diagram illustrating an electrical configuration of the print head according to the first embodiment.

FIG. 6 is a block diagram illustrating the electrical configuration of the print head 26. As described above, the print head 26 includes the driving IC 62 and the plurality of ejecting units 600. In addition, the driving IC 62 includes a switch controller 220 and the plurality of switching circuits 230.

The switch controller 220 is configured to include a shift register (S/R) 222, a latch circuit 224, and a decoder 226. In the switch controller 220, a set of the shift register 222, the latch circuit 224, and the decoder 226 is provided in accordance with each of the piezoelectric elements 37. That is, the number of the sets of the shift register 222, the latch circuit 224, and the decoder 226 included in the driving IC 62 is the same as the total number 2M of the nozzles N included in the print head 26.

The clock signal Sck, the print data signal SI, and the latch signal LAT are supplied to the switch controller 220. In addition, the print data signal SI is a signal which includes print data (SIH and SIL) of 2 bits associated with each of the ejecting units 600 of 2M (piezoelectric element 37).

The shift register 222 is configured to temporarily hold the print data (SIH and SIL) of 2 bits included in the print data signal SI for each of the ejecting units 600 of 2M. In detail, the shift registers 222 having the number of stages corresponding to the ejecting unit 600 are cascade-connected to one another and the print data signal SI is sequentially transmitted to the next stage according to the clock signal Sck.

In FIG. 6, in order to distinguish a plurality of the shift register 222, it is sequentially denoted as the first stage, second stage, . . . , and 2M-th stage from an upstream side to which the print data signal SI is supplied.

Each of the latch circuits 224 of 2M latches the print data (SIH and SIL) of 2 bits held by each of the corresponding shift register 222 of 2M at the rise of the latch signal LAT.

Each of the decoders 226 of 2M decodes the print data (SIH and SIL) of 2 bits latched by each of the corresponding latch circuits 224 of 2M and outputs switch control signals Sa, Sb, and Sc to the switching circuit 230 every the cycle Ta.

Figures 7, 8:
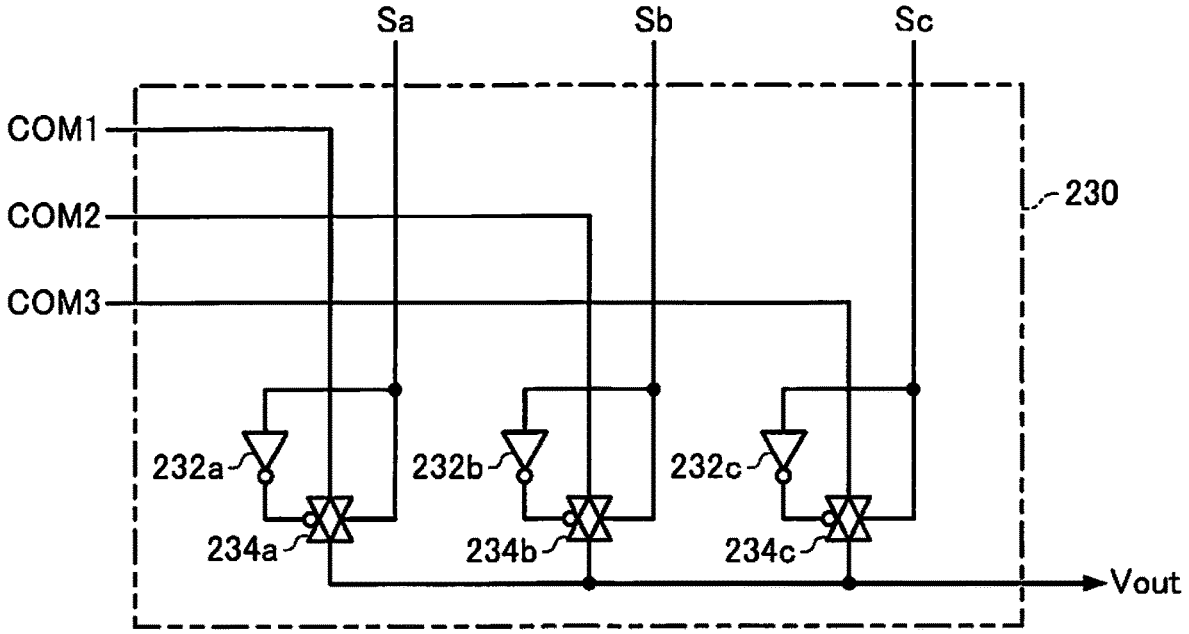
FIG. 7 is a diagram illustrating an example of decode contents according to the first embodiment.
FIG. 8 is a diagram illustrating a configuration of a switching circuit according to the first embodiment.

FIG. 7 is a diagram illustrating an example of decode contents of the decoder 226 according to the first embodiment.

In FIG. 7, when the print data (SIH and SIL) of 2 bits is (1, 0), the decoder 226 outputs a logical level of the switch control signal Sa in the cycle Ta as an L level, outputs the logical level of the switch control signal Sb as a H level, and outputs the logical level of the switch control signal Sc as the L level.

The logical levels of the switch control signals Sa, Sb, and Sc are level-shifted to high amplitude logic than the logical levels of the clock signal Sck, the print data signal SI, and the latch signal LAT by a level shifter (not illustrated).

Returning to FIG. 6, the switching circuit 230 outputs the driving signals COM1, COM2, and COM3 as the driving signal Vout to each of the plurality of ejecting units 600 by selecting or not selecting the driving signals COM1, COM2, and COM3 based on the switch control signals Sa, Sb, and Sc input from the switch controller 220. The switching circuit 230 is provided in accordance with each of the piezoelectric elements 37. For this reason, the number of the switching circuits 230 included in the driving IC 62 is the same as the total number 2M of the nozzles N included in the print head 26.

FIG. 8 is a diagram illustrating a configuration of the switching circuit 230 corresponding to the one piezoelectric element 37 (ejecting unit 600). As illustrated in FIG. 8, the switching circuit 230 includes inverters (not circuits) 232*a*, 232*b*, and 232*c* and the switches 234*a*, 234*b*, and 234*c*. The switches 234*a*, 234*b*, and 234*c* are configured by transfer gates and the like.

The switch control signals Sa, Sb, and Sc are input from the decoder 226 to the switching circuit 230.

While the switch control signal Sa is supplied to a positive control end, to which a circle symbol is not attached, in the switch 234*a*, the switch control signal Sa is logically inverted by the inverter 232*a* and is supplied to a negative control end, to which the circle symbol is attached, in the switch 234*a*. When the switch control signal Sa is the H level, the switch 234*a* conducts (ON) between an input end and an output end and when the switch control signal Sa is the L level, the switch 234*a* non-conducts (OFF) between the input end and the output end. In this way, when the switch control signal Sa is the H level, the switch 234*a* outputs the driving signal COM1 supplied to the input end. When the switch control signal Sa is the L level, the switch 234*a* does not output the signal.

In the same manner, while the switch control signal Sb is supplied to a positive control end, to which a circle symbol is not attached, in the switch 234*b*, the switch control signal Sb is logically inverted by the inverter 232*b* and is supplied to a negative control end, to which the circle symbol is attached, in the switch 234*b*. When the switch control signal Sb is the H level, the switch 234*b* conducts (ON) between an input end and an output end and when the switch control signal Sb is the L level, the switch 234*b* non-conducts (OFF) between the input end and the output end. In this way, when the switch control signal Sb is the H level, the switch 234*b* outputs the driving signal COM2 supplied to the input end. When the switch control signal Sb is the L level, the switch 234*b* does not output the signal.

In the same manner, while the switch control signal Sc is supplied to a positive control end, to which a circle symbol is not attached, in the switch 234*c*, the switch control signal Sc is logically inverted by the inverter 232*c* and is supplied to a negative control end, to which the circle symbol is attached, in the switch 234*c*. When the switch control signal Sc is the H level, the switch 234*c* conducts (ON) between an input end and an output end and when the switch control signal Sb is the L level, the switch 234*c* non-conducts (OFF) between the input end and the output end. In this way, when the switch control signal Sc is the H level, the switch 234*c* outputs the driving signal COM3 supplied to the input end. When the switch control signal Sc is the L level, the switch 234*c* does not output the signal.

The output ends of the switches 234*a*, 234*b*, and 234*c* are commonly connected and the driving signal Vout is output to the ejecting unit 600 via the common terminal.

As described above, the switching circuit 230 selects the driving signals COM1, COM2, and COM3 based on the switch control signals Sa, Sb, and Sc from the decoder 226 and switches whether or not to supply the driving signals COM1, COM2, and COM3 to the piezoelectric element 37 as the driving signal Vout. The driving signals COM1, COM2, and COM3 are preferably voltage waveforms with a voltage amplitude and a high voltage (for example, 42V peak) enough to only drive the piezoelectric element 37 and the switch control signals Sa, Sb, and Sc which control conduction or non-conduction of the driving signals COM1, COM2, and COM3 are preferably voltage signals with the high voltage.

Figure 9:
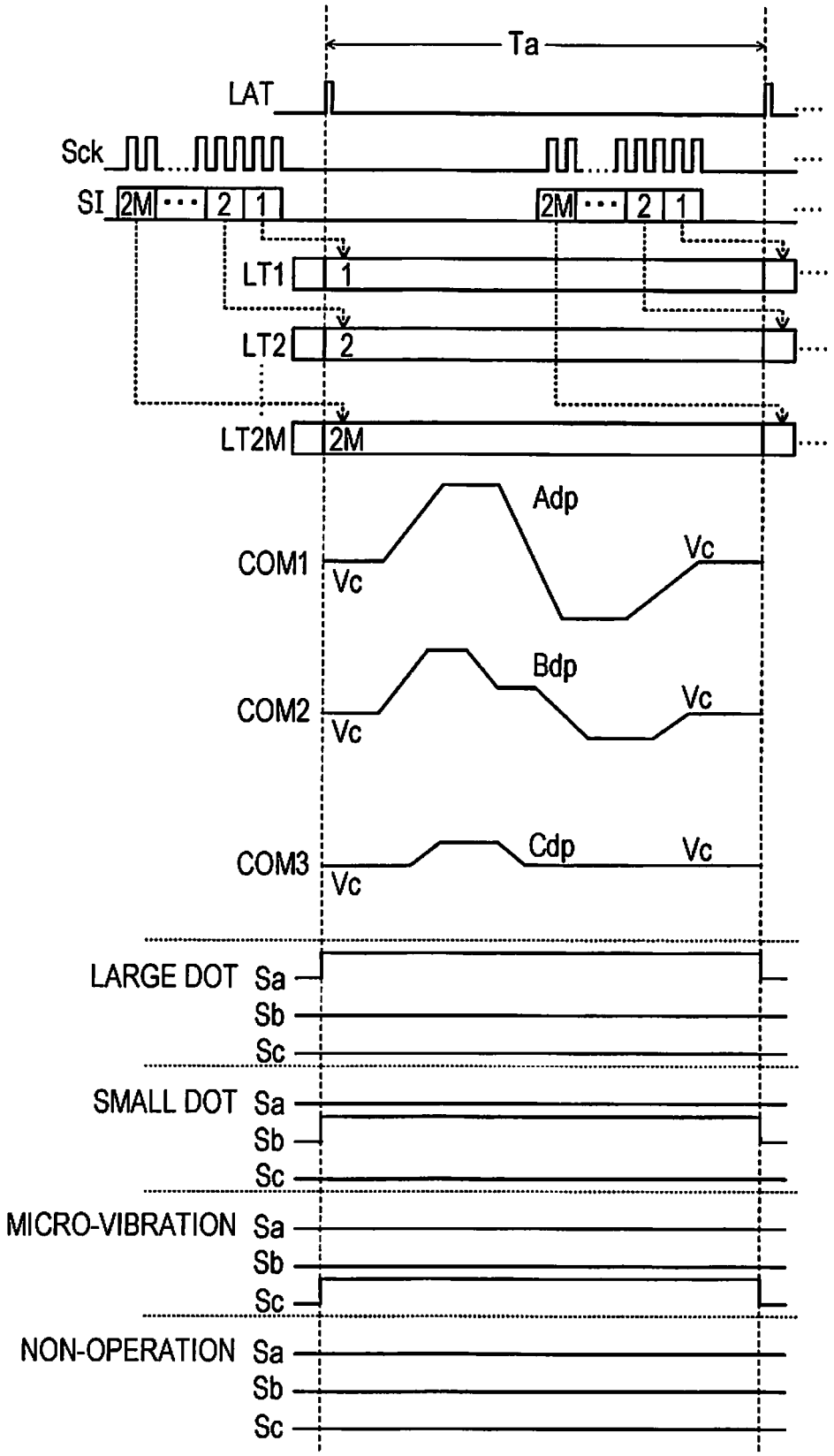
FIG. 9 is a block diagram illustrating an operation of the print head according to the first embodiment.

Hereinafter, an operation of the driving IC 62 will be described in detail with reference to FIG. 9.

When the print data signal SI in synchronization with the clock signal Sck is supplied from the control circuit 10 to the switch controller 220 as a serial signal, the print data signal SI is sequentially transmitted to the shift register 222 corresponding to each of the plurality of ejecting units 600. Then, if the supply of the clock signal Sck is stopped, each of the shift registers 222 is at a state in which the print data (SIH and SIL) of 2 bits corresponding to the driving signal Vout supplied to the ejecting unit 600 (piezoelectric element 37) is held. The print data signal SI is supplied in order corresponding to the nozzles of the last 2M-th stage, . . . , second stage, and first stage in the shift register 222.

Here, when the latch signal LAT rises, each of the latch circuits 224 simultaneously latches the print data (SIH and SIL) of 2 bits held by the shift register 222. In FIG. 9, LT1, LT2, . . . , and LT2M illustrate the print data (SIH and SIL) of 2 bits latched by the latch circuit 224 corresponding to the shift register 222 of first stage, second stage, . . . , and 2M-th stage.

As prescribed in FIG. 7, the decoder 226 outputs the latched print data (SIH and SIL) of 2 bits as the switch control signals Sa, Sb, and Sc in the cycle Ta.

Specifically, when the print data (SIH and SIL) is (1, 1), the decoder 226 respectively outputs the logical level of the switch control signal Sa in the cycle Ta as the H level, outputs the logical level of the switch control signal Sb in the cycle Ta as the L level, and outputs the logical level of the switch control signal Sc in the cycle Ta as the L level to the switching circuit 230. Accordingly, only the switch 234*a* to which the switch control signal Sa is input is conducted during the cycle Ta. Therefore, the driving signal COM1 (voltage waveform Adp) is selected and output as the driving signal Vout. At this time, the large dot is formed on the medium 12 by ejecting a large amount of the ink from the ejecting unit 600 corresponding to the switching circuit 230, to which the signal is input, among the plurality of switching circuits 230.

In addition, when the print data (SIH and SIL) is (1, 0), the decoder 226 respectively outputs the logical level of the switch control signal Sa in the cycle Ta as the L level, outputs the logical level of the switch control signal Sb in the cycle Ta as the H level, and outputs the logical level of the switch control signal Sc in the cycle Ta as the L level to the switching circuit 230. Accordingly, only the switch 234*b* to which the switch control signal Sb is input is conducted during the cycle Ta. Therefore, the driving signal COM2 (voltage waveform Bdp) is selected and output as the driving signal Vout. At this time, the small dot is formed on the medium 12 by ejecting a small amount of the ink from the ejecting unit 600 corresponding to the switching circuit 230, to which the signal is input, among the plurality of switching circuits 230.

In addition, when the print data (SIH and SIL) is (0, 1), the decoder 226 respectively outputs the logical level of the switch control signal Sa in the cycle Ta as the L level, outputs the logical level of the switch control signal Sb in the cycle Ta as the L level, and outputs the logical level of the switch control signal Sc in the cycle Ta as the H level to the switching circuit 230. Accordingly, only the switch 234*c* to which the switch control signal Sc is input is conducted during the cycle Ta. Therefore, the driving signal COM3 (voltage waveform Cdp) is selected and output as the driving signal Vout. At this time, the piezoelectric element 37 included in the ejecting unit 600 corresponding to the switching circuit 230, to which the signal is input, among the plurality of switching circuits 230 micro-vibrates. Therefore, since the ink is not ejected from the ejecting unit 600, the dot is not formed on the medium 12.

In addition, when the print data (SIH and SIL) is (0, 0), the decoder 226 respectively outputs the logical level of the switch control signal Sa in the cycle Ta as the L level, outputs the logical level of the switch control signal Sb in the cycle Ta as the L level, and outputs the logical level of the switch control signal Sc in the cycle Ta as the L level to the switching circuit 230. Accordingly, all of the switches 234*a*, 234*b*, and 234*c* are non-conducted. Therefore, the switching circuit 230, to which the signal is input, among the plurality of switching circuits 230 does not output the driving signal Vout (voltage waveform). At this time, the piezoelectric element 37 included in the ejecting unit 600 corresponding to the switching circuit 230 is not driven. Therefore, since the ink is not ejected from the ejecting unit 600, the dot is not formed on the medium 12.

As described above, the print data signal SI includes the plurality of signals for ejecting the ink from the ejecting unit 600 and the signal for not ejecting the ink from the ejecting unit 600. Further, the print data signal SI includes two kinds of signals of the signal for outputting the driving signal Vout for micro-vibration of the piezoelectric element 37 and the signal for not supplying the driving signal Vout to the piezoelectric element 37, as the signals for not ejecting the ink from the ejecting unit 600.

The driving signals COM1, COM2, and COM3 and the voltage waveforms Adp, Bdp, and Cdp illustrated in FIG. 5 are merely examples. Actually, various combinations of voltage waveforms prepared in advance are used according to a transport speed, properties, and the like of the medium 12. In addition, the print data (SIH and SIL) illustrated in FIG. 7 is merely an example and may be configured to include data of 3 bits or more, for example.

1.6 Generation of Print Data Signal

Here, generation of the print data signal SI which includes the plurality of signals (hereinafter, referred to as ejecting signal) for ejecting the ink from the ejecting unit 600, the signal (hereinafter, referred to as micro-vibration signal) for micro-vibrating the piezoelectric element 37, and the signal (hereinafter, referred to as non-operation signal) for not supplying the driving signal Vout to the piezoelectric element 37 based on the image data input from the host computer will be described with reference to FIGS. 10 to 12. Here, the ejecting signal corresponds to (1, 1) or (1, 0) of the print data (SIH and SIL), the micro-vibration signal corresponds to (0, 1) of the print data (SIH and SIL), and the non-operation signal corresponds to (0, 0) of the print data (SIH and SIL).

Figure 10:
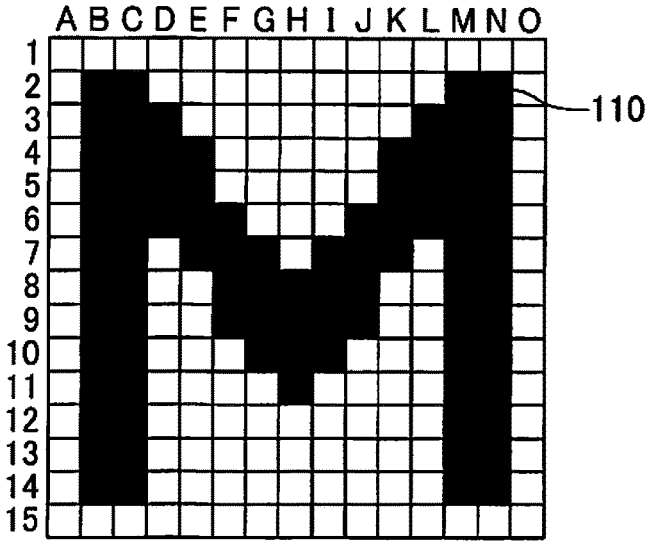
FIG. 10 is a diagram illustrating an example of a print image based on image data input from a host computer.
Figure 11:
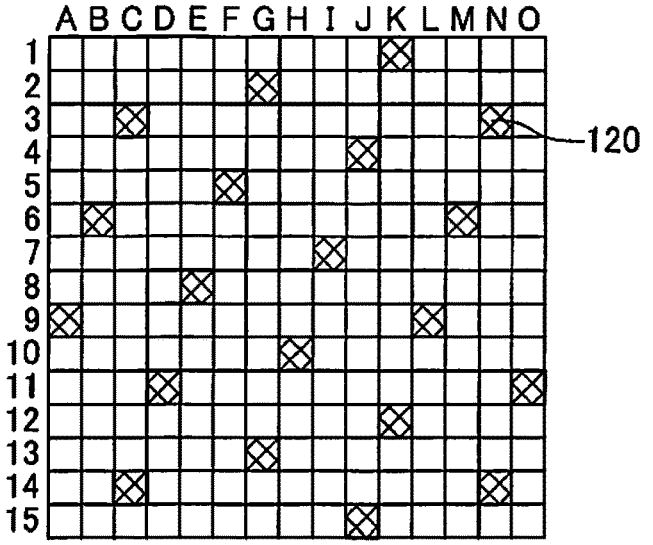
FIG. 11 is a diagram illustrating a non-operational region stored by a control circuit.
Figure 12:
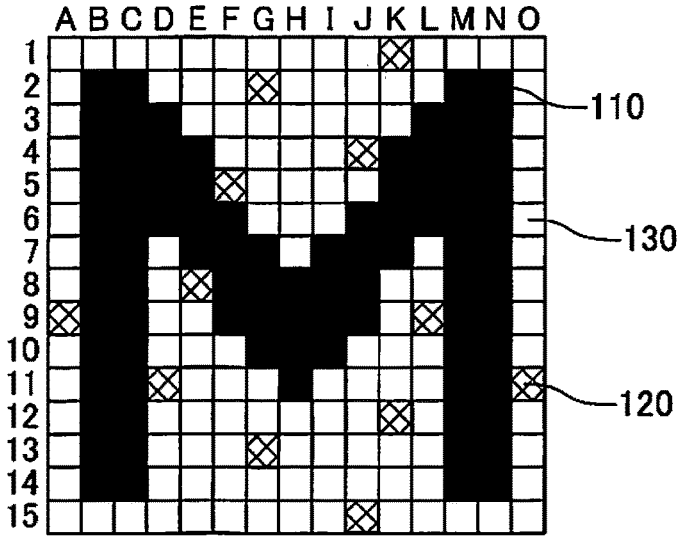
FIG. 12 is a diagram illustrating an example of a print image based on a print data signal.

In FIGS. 10 to 12, for simplicity of explanation, the image data input from the host computer is white and black print data without a gradation and therefore, only one type of the signal for ejecting the ink from the ejecting unit 600 will be described. In addition, each of the 15×15 regions in FIGS. 10 to 12 schematically illustrates a region in which the dot can be formed by one ejecting unit 600 during the cycle Ta. Each of the 15×15 regions is referred to as a pixel region.

FIG. 10 is a diagram illustrating an example of the image data input from the host computer. The pixel region denoted by black color in FIG. 10 indicates an ejection region 110 in which the ink is ejected from the corresponding nozzle N when the ejecting unit 600 is positioned in the pixel region.

In addition, FIG. 11 is a diagram illustrating a non-operational region 120 stored by the control circuit 10 corresponding to the pixel region. The pixel region by hatching illustrated in FIG. 11 indicates the non-operational region 120 for outputting the non-operation signal stored by the control circuit 10.

FIG. 12 is a diagram illustrating an example of the print image based on the print data signal SI generated based on the ejection region 110 by the image data input from the host computer and the non-operational region 120 obtained by outputting the non-operation signal stored in the control circuit 10.

The control circuit 10 generates the print data signal SI by comparing the ejection region 110 indicated by the image data with the non-operational region 120 stored in the control circuit 10 for each of the pixel regions.

Specifically, firstly, the control circuit 10 determines whether or not the pixel region is the ejection region 110 based on the image data input from the host computer. When the pixel region is the ejection region 110, the ejecting signal is generated as the print data corresponding to the pixel region.

Secondly, when the pixel region is not the ejection region 110, the control circuit 10 determines whether or not the pixel region is the non-operational region 120 stored in the control circuit 10. When the pixel region is the non-operational region 120, the non-operation signal is generated as the print data corresponding to the pixel region.

Thirdly, when the pixel region is a region which is none of the ejection region 110 and the non-operational region 120 described above, the control circuit 10 determines that the pixel region is a micro-vibration region 130 and the micro-vibration signal is generated as the print data corresponding to the pixel region.

The control circuit 10 generates the print data signal SI along the nozzle row in pixel region unit. For example, when the nozzle row of the print head 26 is formed by the nozzles N juxtaposed along the row direction illustrated in FIGS. 10 to 12 and the carriage 242 mounting the print head 26 moves in the column direction illustrated in FIGS. 10 to 12, the control circuit 10 generates the print data corresponding to the pixel region to column 1×row A in order of column 1×row A, column 1×row B, and column 1×row O and outputs the print data to the print head 26 as the print data signal SI of a serial signal. Thereafter, the control circuit 10 generates the print data signal SI in order of the second column, the third column, . . . and outputs the print data signal SI to the print head 26.

As described above, the print head 26 generates the driving signal Vout based on the print data signal SI output from the control circuit 10 and forms the dot on the medium 12.

Figure 13:
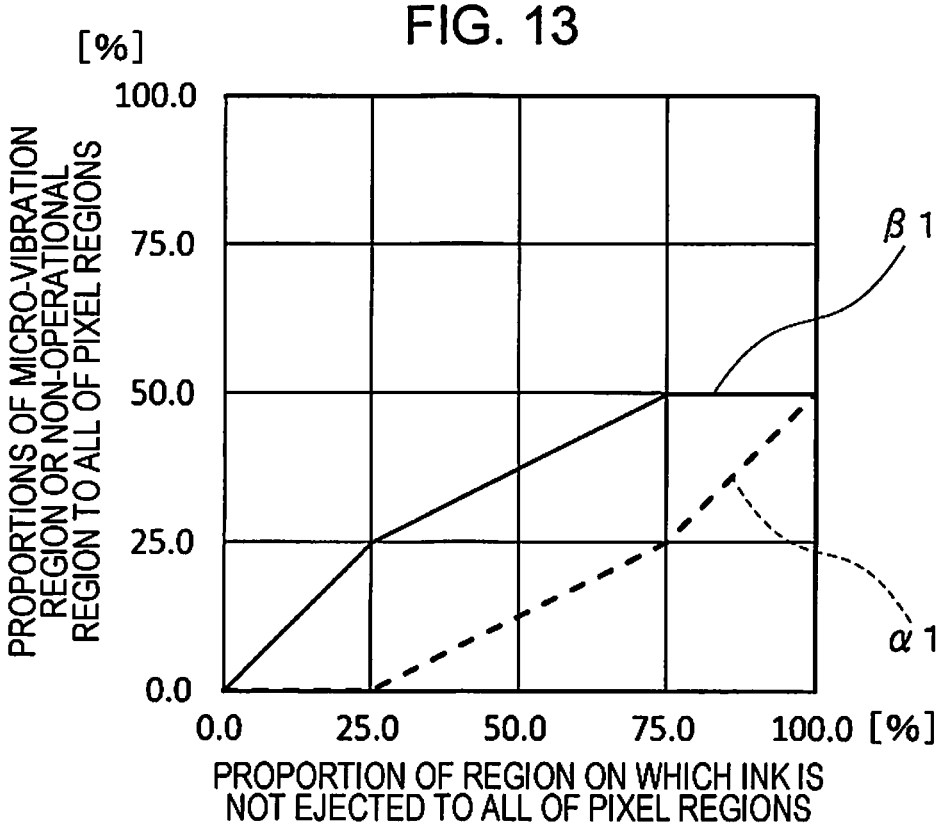
FIG. 13 is a diagram illustrating proportions of the non-operational region or a micro-vibration region to all of pixel regions.

Although the non-operational region 120 is described as being stored in the control circuit 10, as illustrated in FIG. 13, based on the image data input from the host computer, the non-operational region 120 may be divided based on a proportion of the ejection region 110 to all of the pixel regions in the image data.

FIG. 13 is a diagram illustrating "proportions of non-operational region 120 or micro-vibration region 130" with respect to "proportion of region on which ink is not ejected to all of pixel regions". In addition, FIG. 14 is a diagram illustrating "proportions of non-operational region 120 or micro-vibration region 130" with respect to "proportion of region on which ink is not ejected to all of pixel regions".

In FIG. 13, al indicates $\alpha 1$ proportion of the non-operational region 120 to all of the pixel regions and $\beta 1$ indicates a proportion of the micro-vibration region 130 to all of the pixel regions. In addition, in FIG. 14, $\alpha 2$ indicates a proportion of the non-operational region 120 to the region on which the ink is not ejected and $\beta 1$ indicates a proportion of the micro-vibration region 130 to the region on which the ink is not ejected.

Figure 14:
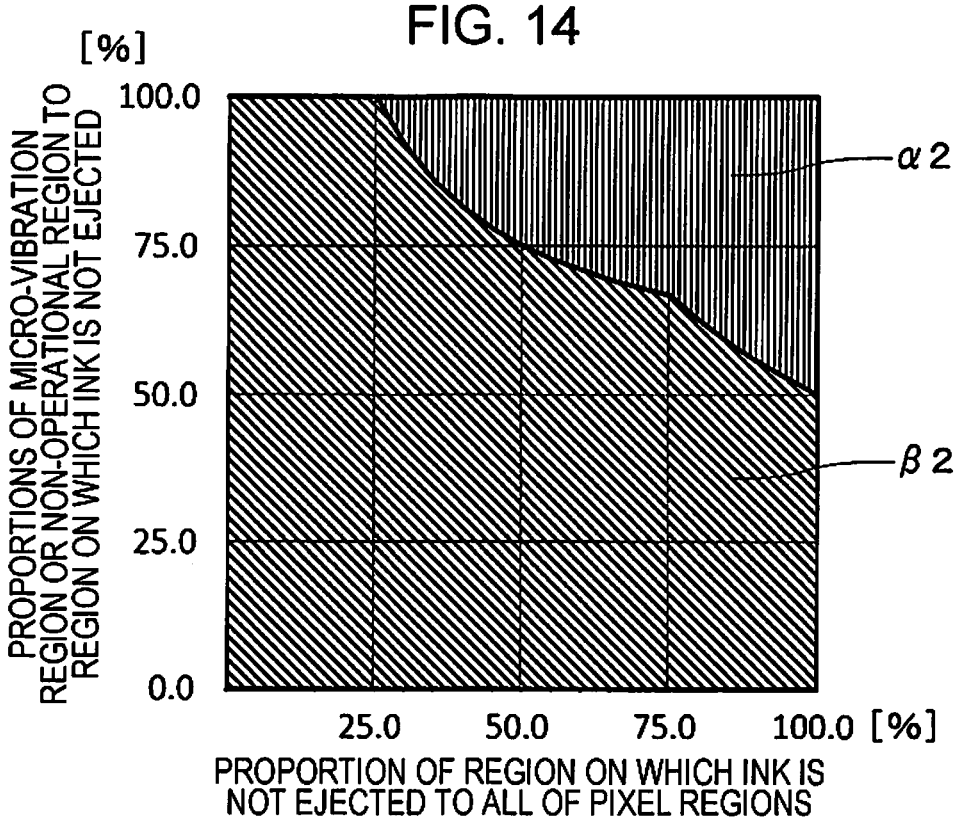
FIG. 14 is a diagram illustrating proportions of the non-operational region or the micro-vibration region to regions on which an ink is not ejected.

As illustrated in FIGS. 13 and 14, when a proportion of the ejection region 110 to all of the pixel regions in the image data is large, that is, when the region on which the ink is not ejected is small, a ratio of the non-operational region 120 ($\alpha 1$ and $\alpha 2$) to the micro-vibration region 130 ($\beta 1$ and $\beta 2$) is preferably low. On the other hand, when a proportion of the ejection region 110 to all of the pixel regions in the image data is small, that is, when the region on which the ink is not ejected is large, the ratio of the non-operational region 120 to the micro-vibration region 130 is preferably high.

Specifically, as illustrated in FIGS. 13 and 14, when the proportion of the region on which the ink is not ejected to all of the pixel regions of the image data transmitted from the host computer is equal to or less than 25%, since a temperature rise of the driving IC 62 due to the micro-vibration is small, all of the pixel regions on which the ink is not ejected may be set as the micro-vibration region 130. In addition, the proportion of the region on which the ink is not ejected to all of the pixel regions in the image data is 25% to 75%, the proportion of the non-operational region 120 to all of the pixel regions becomes preferably 0% to 25%. At this time, as illustrated in FIG. 14, the proportion α2 of the non-operational region 120 to the region on which the ink is not ejected gradually increases as compared with the proportion β2 of the micro-vibration region 130 to the region on which the ink is not ejected. In addition, when the proportion of the region on which the ink is not ejected to all of the pixel regions of the image data exceeds 75%, since heating which occurs in the driving IC 62 due to the micro-vibration is reduced, the proportion of the micro-vibration region 130 to all of the pixel regions is preferably fixed to 50% and the remaining regions are preferably set as the non-operational region 120.

In this way, according to the proportion of the region on which the ink is not ejected to all of the pixel regions of the image data transmitted from the host computer, by changing the proportions of the non-operational region 120 or the micro-vibration region 130 to all of the pixel regions of the image data, it is possible to balance heat dissipation via the ink in the reservoir Q and the pressure chamber C in the print head 26 and the heating of the driving IC 62, and it is possible to reduce the heating which occurs in the driving IC 62.

1.7 Operation and Effect

According to the ink jet printer 100 in the first embodiment, the driving IC 62 includes the plurality of switching circuits 230 which control whether or not the plurality of voltage waveforms (voltage waveforms Adp, Bdp, and Cdp) included in the driving signal Vout are supplied to the corresponding piezoelectric element 37. By one of the plurality of switching circuits 230, the driving signal Vout which includes the voltage waveform Adp or the voltage waveform Bdp is supplied to the corresponding piezoelectric element 37 and the piezoelectric element 37 to which the driving signal Vout is supplied is driven so as to eject the ink from the corresponding nozzle N. At this time, by another of the plurality of switching circuits 230, the driving signal Vout which includes the voltage waveform Cdp is supplied to the corresponding piezoelectric element 37 and the piezoelectric element 37 to which the driving signal Vout is supplied is driven so as not to eject the ink from the corresponding nozzle N. Further, at this time, by further different one of the plurality of switching circuits 230, the plurality of voltage waveforms constituting the driving signal Vout are not supplied to the corresponding piezoelectric element 37 and the ink is not ejected from the corresponding nozzle N. In this way, the plurality of switching circuits 230 supply the voltage waveform Cdp which stirs the ink in a vicinity of the nozzle N by the micro-vibration, to a plurality of nozzles N which do not eject the ink and do not supply any one of the plurality of voltage waveforms, to the others. Accordingly, as the driving signal Vout (voltage waveform) is not supplied to the plurality of nozzles N which do not eject the ink, it is possible to reduce the heating of the driving IC 62.

In addition, since it is possible to reduce the heating of the driving IC 62, in the print head 26, it is possible to reduce a temperature rise of the ink flowing through the space as the heating of the driving IC 62 disposed in the space of the almost closed state, and a change in physical properties of the ink caused by the temperature rise is reduced and it is possible to improve ejection accuracy of the ink jet printer 100.

2. Second Embodiment

In the ink jet printer 100 according to the first embodiment, the driving circuit 50 generates the three kinds of the driving signals COM1, COM2, and COM3 and the driving IC 62 generates the driving signal Vout by switching each of the three kinds of the input driving signals COM1, COM2, and COM3 by the switches 234*a*, 234*b*, and 234*c* included in the switching circuit 230. In the ink jet printer 100 according to the second embodiment, the driving circuit 50 outputs one driving signal COM4 which continuously includes three kinds of the voltage waveforms Adp, Bdp, and Cdp and the switching circuit 230 generates the driving signal Vout by switching between conduct and non-conduct of the driving signal COM4 in a time division manner. Description of the same contents as in the first embodiment will be omitted. The same reference numerals are used for the same components.

Figure 15:
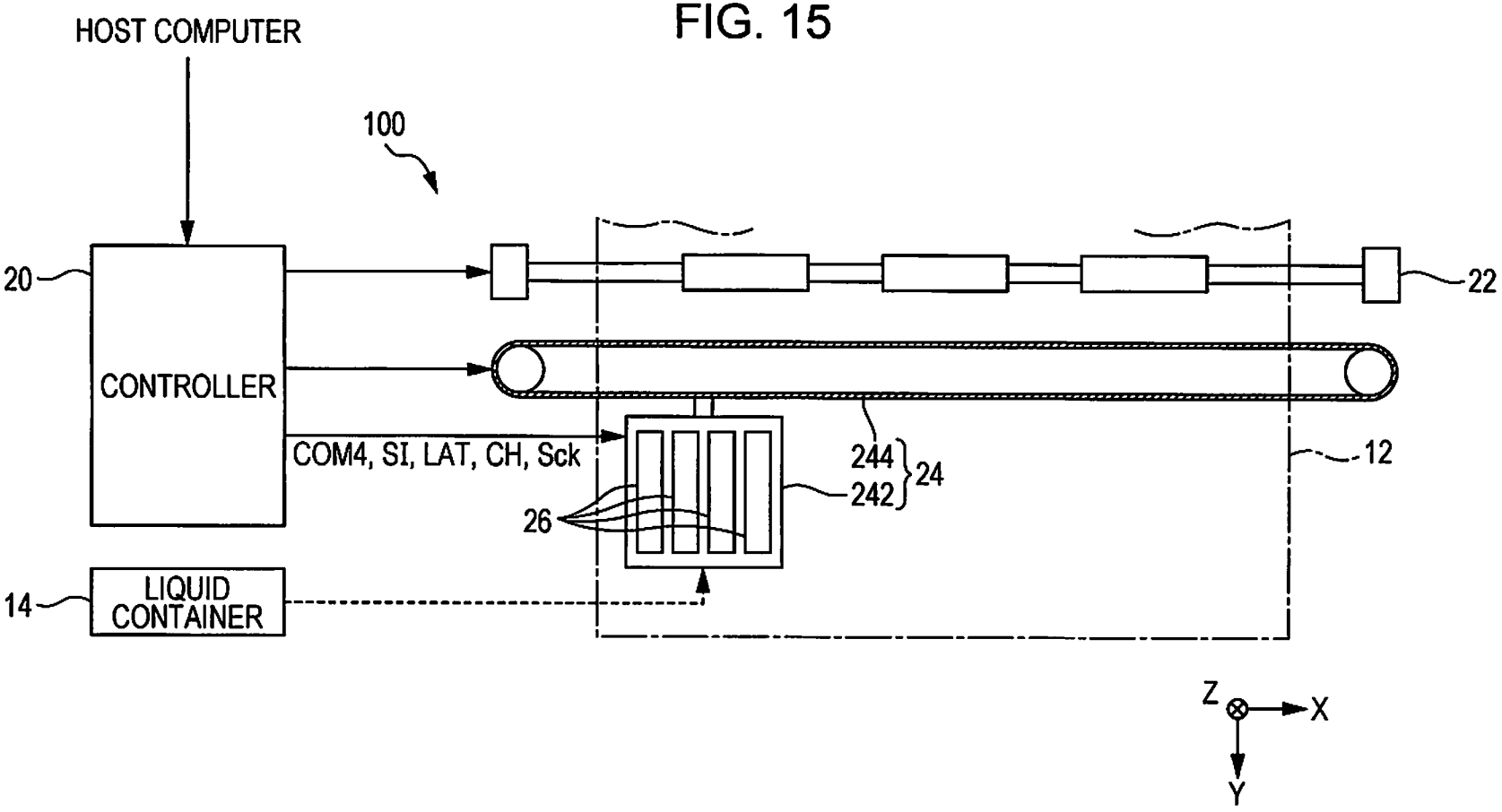
FIG. 15 is a block diagram schematically illustrating an ink jet printer according to a second embodiment.

FIG. 15 is a schematic block diagram illustrating the ink jet printer 100 according to the second embodiment. In the ink jet printer 100 according to the second embodiment, the controller 20 outputs a channel signal CH for controlling a timing of selecting the voltage waveform of the driving signal COM4 in a time division manner to the plurality of print heads 26 in addition to the driving signal COM4, the print data signal SI for controlling the print head 26, the latch signal LAT for controlling the ejection timing, and the clock signal Sck.

Figure 16:
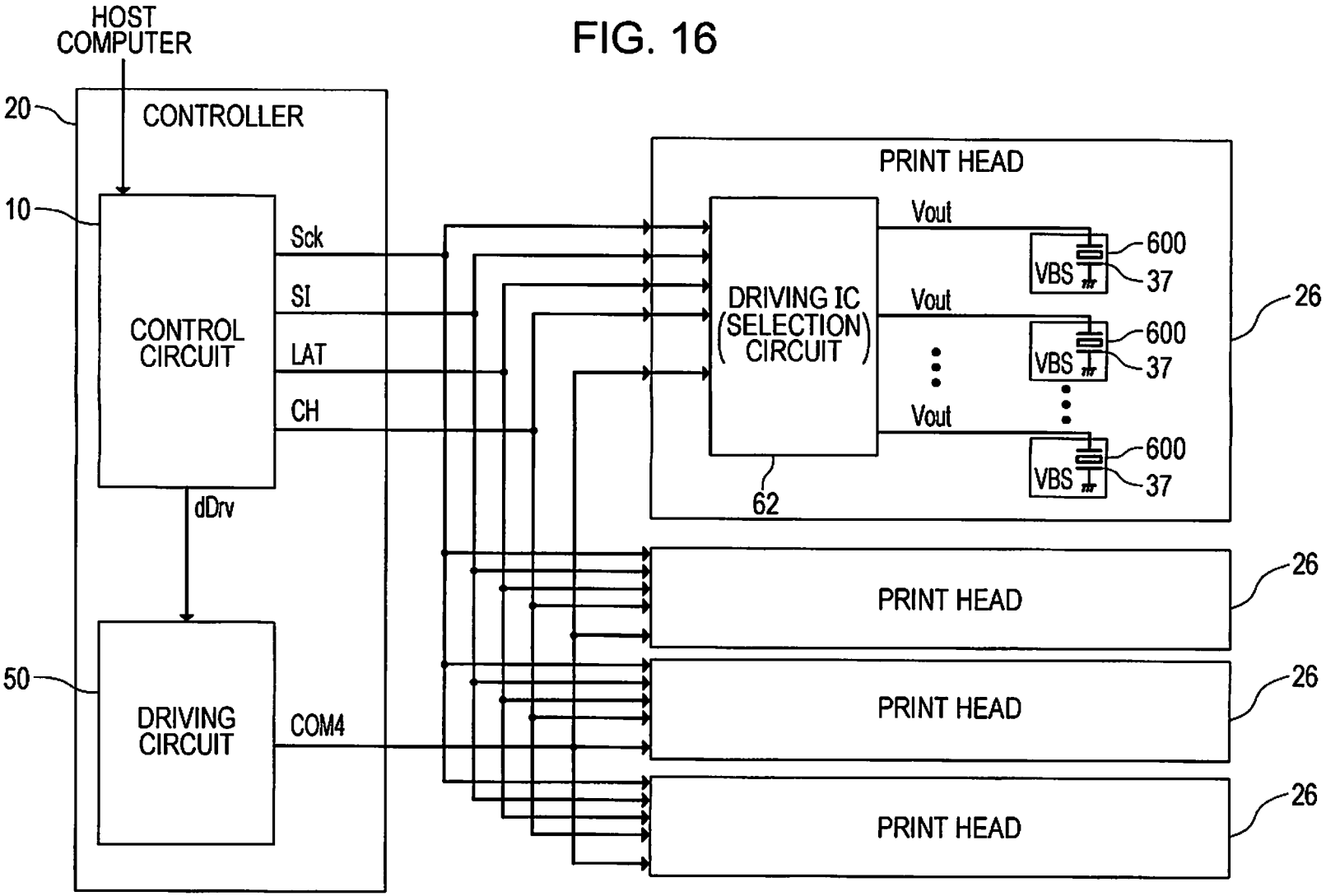
FIG. 16 is a schematic block diagram illustrating an electrical configuration of the ink jet printer according to the second embodiment.

FIG. 16 is a block diagram illustrating a configuration of the controller 20 and the print head 26 of the ink jet printer 100 according to the second embodiment.

As illustrated in FIG. 16, the control circuit 10 outputs the channel signal CH to the print head 26 in addition to the print data signal SI and the latch signal LAT as the plural kinds of control signals for controlling the ejection of the ink.

Figure 17:
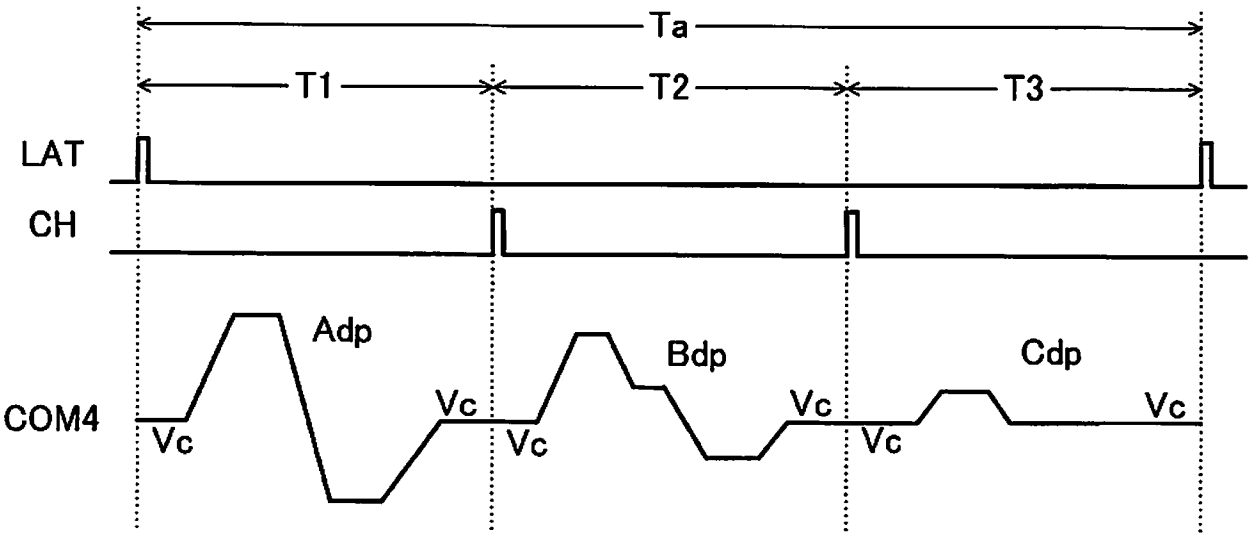
FIG. 17 is a diagram illustrating an example of a driving signal according to the second embodiment.

The driving circuit 50 generates the voltage waveforms Adp, Bdp, and Cdp based on the digital data dDrv input from the control circuit 10 in the same manner as the first embodiment. Then, the driving circuit 50 outputs the driving signal COM4 illustrated in FIG. 17 by outputting the generated voltage waveforms Adp, Bdp, and Cdp in serial.

The voltage waveform Adp is disposed in a cycle T1 from the rise of the latch signal LAT to the next rise of the channel signal CH. The voltage waveform Adp forms a new dot on the medium 12 for the cycle T1. Specifically, when the voltage waveform Adp is supplied to one end of the piezoelectric element 37, a predetermined amount, specifically, a large amount of the ink is ejected from the ejecting unit 600 (nozzle N) including the piezoelectric element 37.

The voltage waveform Bdp is disposed in a cycle T2 from the rise of the channel signal CH to the next rise of the channel signal CH. The voltage waveform Bdp forms a new dot on the medium 12 for the cycle T2. Specifically, when the voltage waveform Bdp is supplied to one end of the piezoelectric element 37, the amount smaller than the predetermined amount, that is, a small amount of the ink is ejected from the ejecting unit 600 (nozzle N) including the piezoelectric element 37.

The voltage waveform Cdp is disposed in a cycle T3 from the rise of the channel signal CH to the rise of the latch signal LAT. The voltage waveform Cdp is a waveform for micro-vibrating the ink in the vicinity of the ejecting unit 600 to prevent the increase in viscosity of the ink. For this reason, even if the voltage waveform Cdp is supplied to one end of the piezoelectric element 37, the ink droplet is not ejected from the nozzle N corresponding to the piezoelectric element 37. That is, the voltage waveform Cdp is a waveform for micro-vibrating the piezoelectric element 37.

The cycle Ta, which is the printing cycle in the second embodiment, is a total period of the cycles T1, T2, and T3 when each of the voltage waveforms Adp, Bdp, and Cdp is supplied to the piezoelectric element 37.

Figure 18:
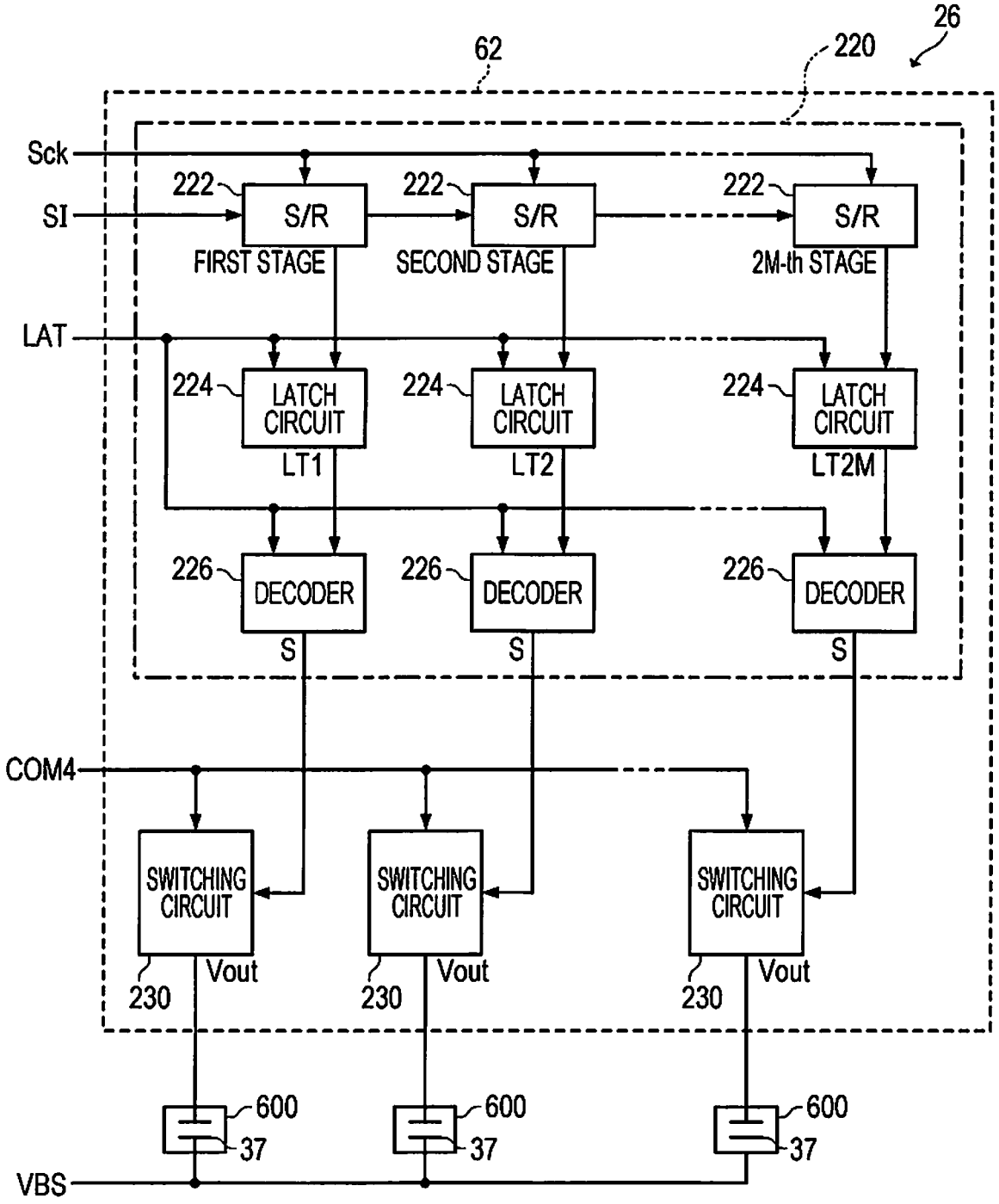
FIG. 18 is a block diagram illustrating an electrical configuration of a print head according to the second embodiment.

FIG. 18 is a block diagram illustrating an electrical configuration of the print head 26 according to the second embodiment.

The print head 26 according to the second embodiment includes the driving IC 62 and the plurality of ejecting units 600 in the same manner as the first embodiment. In addition, the driving IC 62 includes the switch controller 220 and the switching circuit 230.

The switch controller 220 is configured to include the shift register 222, the latch circuit 224, and the decoder 226. The shift register 222 and the latch circuit 224 are the same as in the first embodiment, and a description thereof will be omitted.

Each of the decoders 226 decodes the print data (SIH and SIL) of 2 bits latched by each of the latch circuits 224 in the same manner as the first embodiment and outputs a switch control signal S to the switching circuit 230 for the cycles T1, T2, and T3 prescribed by the latch signal LAT and the channel signal CH.

Figures 19, 20:
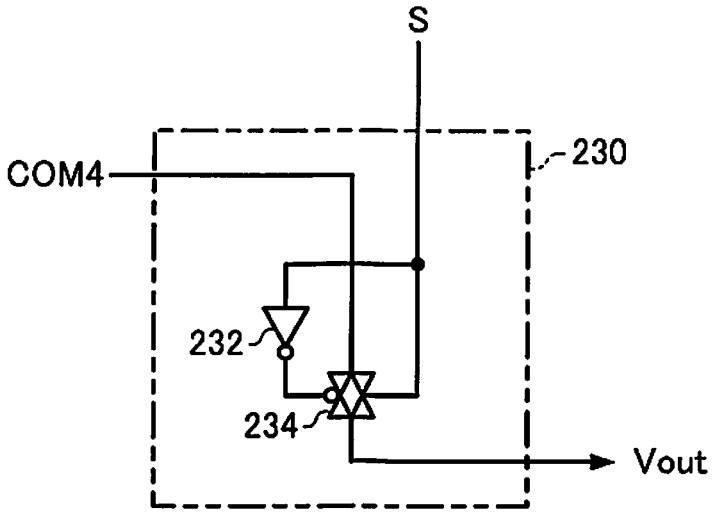
FIG. 19 is a diagram illustrating an example of decode contents according to the second embodiment.
FIG. 20 is a diagram illustrating a configuration of a switching circuit according to the second embodiment.

FIG. 19 is a diagram illustrating decode contents of the decoder 226 according to the present embodiment.

In FIG. 19, for example, when the print data (SIH and SIL) of 2 bits is (1, 0), the decoder 226 outputs the logical level of the switch control signal S for the cycle T1 as the L level, outputs the logical level of the switch control signal S for the cycle T2 as the H level, and outputs the logical level of the switch control signal S for the cycle T3 as the L level.

Returning to FIG. 18, the switching circuit 230 outputs the driving signal COM4 to each of the plurality of ejecting units 600 as the driving signal Vout by selecting or not selecting the driving signal COM4 for each of the cycles T1, T2, and T3 based on the switch control signal S input from the switch controller 220.

FIG. 20 is a diagram illustrating a configuration of the switching circuit 230 corresponding to the one piezoelectric element 37 (ejecting unit 600) according to the second embodiment. As illustrated in FIG. 20, the switching circuit 230 includes an inverter 232 and a switch 234.

While the switch control signal S is supplied to a positive control end, to which a circle symbol is not attached, in the switch 234, the switch control signal S is logically inverted by the inverter 232 and is supplied to a negative control end, to which the circle symbol is attached, in the switch 234. When the switch control signal S is the H level, the switch 234 conducts (ON) between an input end and an output end and when the switch control signal Sb is the L level, the switch 234 non-conducts (OFF) between the input end and the output end. In this way, when the switch control signal S is the H level, the switch 234 outputs the driving signal COM4 supplied to the input end. When the switch control signal S is the L level, the switch 234 does not output the signal.

Figure 21:
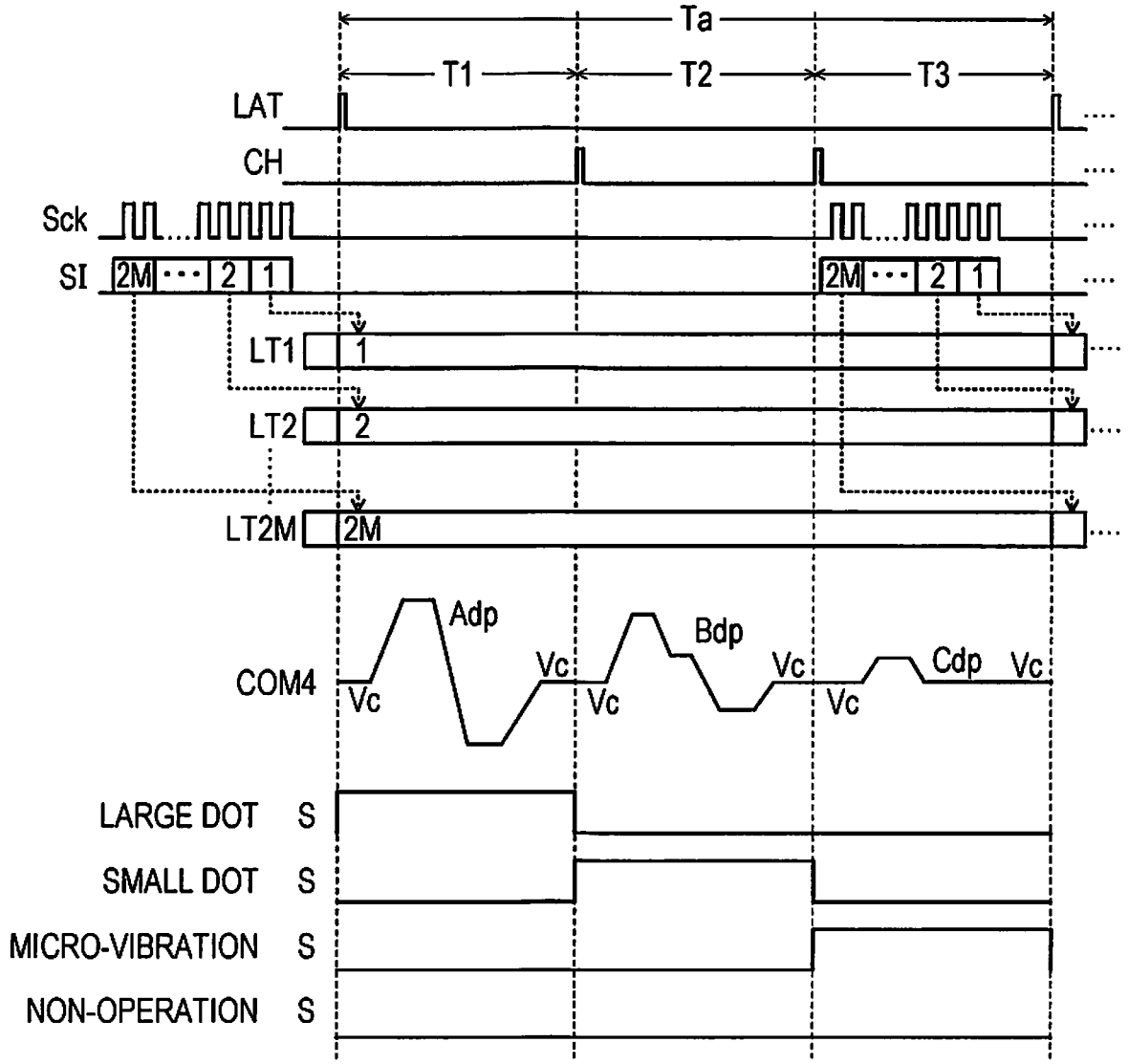
FIG. 21 is a block diagram illustrating an operation of the print head according to the second embodiment.

FIG. 21 is a diagram illustrating a detail of an operation of the driving IC 62 in the second embodiment.

In the same manner as the first embodiment, when the print data signal SI in synchronization with the clock signal Sck is supplied to the switch controller 220 in serial, the driving IC 62 sequentially transmits the print data signal SI to the shift register 222 corresponding to each of the plurality of ejecting units 600. Then, if the supply of the clock signal Sck is stopped, each of the shift registers 222 is at a state in which the print data (SIH and SIL) of 2 bits corresponding to the driving signal Vout supplied to the ejecting unit 600 (piezoelectric element 37) is held. The print data signal SI is supplied in order corresponding to the nozzles of the last 2M-th stage, . . . , second stage, and first stage in the shift register 222.

Here, when the latch signal LAT rises, each of the latch circuits 224 simultaneously latches the print data (SIH and SIL) of 2 bits held by the shift register 222. In FIG. 21, LT1, LT2, . . . , and LT2M illustrate the print data (SIH and SIL) of 2 bits latched by the latch circuit 224 corresponding to the shift register 222 of first stage, second stage, . . . , and 2M-th stage.

As prescribed in FIG. 19, the decoder 226 outputs the latched print data (SIH and SIL) of 2 bits as the switch control signal S in the cycles T1, T2, and T3.

Specifically, when the print data (SIH and SIL) is (1, 1), the decoder 226 respectively outputs the logical level of the switch control signal S in the cycle T1 as the H level, outputs the logical level of the switch control signal S in the cycle T2 as the L level, and outputs the logical level of the switch control signal S in the cycle T3 as the L level, to the switching circuit 230. At this time, the switching circuit 230 conducts the switch 234 for the cycle T1. Therefore, the voltage waveform Adp is selected for the cycle Ta and the driving signal COM4 is output as the driving signal Vout. Thus, the large dot is formed on the medium 12.

In addition, when the print data (SIH and SIL) is (1, 0), the decoder 226 respectively outputs the logical level of the switch control signal S in the cycle T1 as the L level, outputs the logical level of the switch control signal S in the cycle T2 as the H level, and outputs the logical level of the switch control signal S in the cycle T3 as the L level, to the switching circuit 230. At this time, the switching circuit 230 conducts the switch 234 for the cycle T2. Therefore, the voltage waveform Bdp is selected for the cycle Ta and the driving signal COM4 is output as the driving signal Vout. Thus, the small dot is formed on the medium 12.

In addition, when the print data (SIH and SIL) is (0, 1), the decoder 226 respectively outputs the logical level of the switch control signal S in the cycle T1 as the L level, outputs the logical level of the switch control signal S in the cycle T2 as the L level, and outputs the logical level of the switch control signal S in the cycle T3 as the H level, to the switching circuit 230. At this time, the switching circuit 230 conducts the switch 234 for the cycle T3. Therefore, the voltage waveform Cdp is selected for the cycle Ta and the driving signal COM4 is output as the driving signal Vout. As a result, the piezoelectric element 37 micro-vibrates and the dot is not formed on the medium 12 at this time.

In addition, when the print data (SIH and SIL) is (0, 0), the decoder 226 respectively outputs the logical level of the switch control signal S in the cycle T1 as the L level, outputs the logical level of the switch control signal S in the cycle T2 as the L level, and outputs the logical level of the switch control signal S in the cycle T3 as the L level, to the switching circuit 230. At this time, the switching circuit 230 non-conducts the switch 234 for the cycle Ta. For this reason, the switching circuit 230 does not output the driving signal Vout. Thus, the dot is not formed on the medium 12.

In this way, the driving signal COM4 according to the second embodiment is a waveform which includes the voltage waveform Adp for forming the large dot, the voltage waveform Bdp for forming the small dot, and the voltage waveform Cdp for not forming the dot in a time division manner. The switch control signal S selects whether or not to form the dot by outputting one of the voltage waveforms to the driving signal COM4 as the driving signal Vout based on the channel signal CH. By selectively outputting the driving signal Vout from the driving signal COM4 in a time division manner, it is possible to simply the configuration of the switching circuit 230.

In addition, when the print data (SIH and SIL) is (0, 0) in the same manner as the first embodiment, since the driving signal Vout is not supplied to the piezoelectric element 37, the driving IC 62 can obtain the same effects as those of the first embodiment.

3. Modification Example

In the first embodiment, the driving signal COM1 which includes the voltage waveform Adp, the driving signal COM2 which includes the voltage waveform Bdp, and the driving signal COM3 which includes the voltage waveform Cdp are input to the print head 26 in parallel. In addition, in the second embodiment, the driving signal COM4 which includes the voltage waveform Adp, the voltage waveform Bdp, and the voltage waveform Cdp in a time division manner is input to the print head 26. The plurality of driving signals COM may be driving signals having a combination of these. For example, a driving signal COM-A which includes two voltage waveforms in a time division manner and a driving signal COM-B which includes two voltage waveforms in a time division manner may be input to the print head 26. When the driving signal Vout is supplied to the piezoelectric element 37, the switching circuit 230 selects and outputs the voltage waveform included in the driving signal COM-A or the driving signal COM-B for at least one of the cycle T1 and the cycle T2. In addition, when the driving signal Vout is not supplied to the piezoelectric element 37, the voltage waveform included in one of the driving signal COM-A and the driving signal COM-B also may be not supplied to the piezoelectric element 37 for the cycle Ta.

4. Application Example

In each of the embodiments and the modification example described above, the ink jet printer 100 is a print only machine, but the ink jet printer 100 may be a multi-function printer including a copy function and a scanner function.

In a case of the multi-function printer which requires multi-functions and high integration as compared with a single-function printer only machine, the print head 26 according to the invention is suitable for miniaturization and the high integration as compared with the head in the related art and a greater effect can be obtained from the viewpoint of the higher integration and the miniaturization when the invention is applied to the multi-function printer as compared with a case where the invention is applied to the single-function printer.

In addition, in each of the embodiments and the modification example described above, the ink jet printer 100 is a fixed type device, but the ink jet printer 100 may be a portable type device.

In a case of the portable type device which requires miniaturization from the viewpoint of portability as compared with a stationary type device, the print head 26 according to the invention is suitable for miniaturization as compared with the head in the related art and the greater effect can be obtained from the viewpoint of the miniaturization when the invention is applied to the portable type device as compared with a case where the invention is applied to the stationary type device.

In addition, in each of the embodiments described above, the ink jet printer 100 is a serial printer, but the ink jet printer 100 may be a line printer.

Unlike the serial printer, the line printer is difficult to adjust resolution by overlapping print or the like and the density of the nozzles of the print heads arranged on a line directly affects the resolution of printed matter. In addition, in the line printer, the print head 26 requires high density for miniaturization. Accordingly, the print head 26 according to the invention is suitable for miniaturization as compared with the head in the related art and the greater effect can be obtained from the viewpoint of the miniaturization when the invention is applied to the line printer as compared with a case where the invention is applied to the serial printer.

In addition, in each of the embodiments described above, the ink jet printer 100 is a printer for home office assuming paper as the medium 12, but the ink jet printer 100 may be a textile ink jet printer for printing on cloth or an industrial ink jet printer used for printing shop, factory, and the like.

Unlike the printer for home office, in a case of the textile ink jet printer or the industrial ink jet printer which requires high productivity of a user, is continuously operated for a long time, and is placed under a condition in which the heat is relatively easy to be generated and the continuous driving and the driving at high speed are needed as compared with the head in the related art, the greater effect can be obtained from the viewpoint of productivity when the invention is applied to the textile ink jet printer or the industrial ink jet printer as compared with a case where the invention is applied to the printer for home office.

The present embodiment, the modification example, and the application example are described above, but the invention is not limited to the present embodiment, the modification example, and the application example. The invention can be implemented in various modes without departing from a gist thereof. For example, it is also possible to appropriately combine each of the embodiments, the modification example, and the application example.

The invention includes substantially the same configuration as the configuration described in the embodiment (for example, a configuration having the same function, method and result or a configuration having the same object and effect). In addition, the invention includes a configuration in which non-essential parts of the configuration described in the embodiment are replaced. Further, the invention includes a configuration which achieves the same operational effect as the configuration described in the embodiment or a configuration which can achieve the same object. In addition, the invention includes a configuration in which a known technology is added to the configuration described in the embodiment.

What is claimed is:

1. A liquid ejecting apparatus comprising:

a nozzle row that includes a plurality of nozzles which includes a first nozzle which ejects a liquid by driving a first piezoelectric element, a second nozzle which ejects the liquid by driving a second piezoelectric element, and a third nozzle which ejects the liquid by driving a third piezoelectric element;

a driving circuit that generates a plurality of voltage waveforms which include a first voltage waveform for driving at least one of the first piezoelectric element, the second piezoelectric element and the third piezoelectric element so as to eject the liquid from at least one of the first nozzle, the second nozzle and the third nozzle included in the nozzle row and a second voltage waveform which drives at least one of the first piezoelectric element, the second piezoelectric element and the third piezoelectric element to such an extent that the liquid is not ejected from at least one of the first nozzle, the second nozzle and the third nozzle included in the nozzle row;

a switching IC that includes a plurality of switching circuits which include a first switching circuit which switches whether or not to supply at least one of the first voltage waveform and the second voltage waveform to the first piezoelectric element, a second switching circuit which switches whether or not to supply at least one of the first voltage waveform and the second voltage waveform to the second piezoelectric element, and a third switching circuit which switches whether or not to supply at least one of the first voltage waveform and the second voltage waveform to the third piezoelectric element; and a protective substrate that is provided with the switching IC and is disposed so as to electrically connect the first switching circuit and the first piezoelectric element, to transmit at least one of the first voltage waveform and the second voltage waveform, and to protect the first piezoelectric element, wherein the first switching circuit is switched so that the first voltage waveform is supplied to the first piezoelectric element corresponding to the first nozzle which ejects the liquid, the second switching circuit is switched so that the second voltage waveform is supplied to the second piezoelectric element corresponding to the second nozzle which does not eject the liquid, the third switching circuit is switched so that none of the plurality of voltage waveforms is supplied to the third piezoelectric element corresponding to the third nozzle which does not eject the liquid, the switching IC has a shape which includes a short side and a long side intersected with the short side, and a length of the long side is equal to or larger than 10 times a length of the short side.

2. The liquid ejecting apparatus according to claim 1, wherein the first switching circuit includes a plurality of switches that include a first switch which switches whether or not to supply the first voltage waveform to the first piezoelectric element, and a second switch which switches whether or not to supply the second voltage waveform to the first piezoelectric element.

3. The liquid ejecting apparatus according to claim 2, wherein the plurality of voltage waveforms include a third voltage waveform that drives the piezoelectric element so as to eject a small amount of the liquid as compared with a case of supplying the first voltage waveform, and the first switching circuit includes a third switch that switches whether or not to supply the third voltage waveform to the first piezoelectric element.

4. The liquid ejecting apparatus according to claim 1, wherein the nozzle row is provided with the nozzles at density of 300 or more per inch.

5. The liquid ejecting apparatus according to claim 1, which is an industrial ink jet printer.

6. The liquid ejecting apparatus according to claim 1, which is a textile ink jet printer.

* * * * *